US011873840B2

(12) United States Patent
Michishita et al.

(10) Patent No.: US 11,873,840 B2
(45) Date of Patent: Jan. 16, 2024

(54) MOTOR AND AXIAL FAN

(71) Applicant: Nidec Corporation, Kyoto (JP)

(72) Inventors: Atsushi Michishita, Kyoto (JP); Yuta Yamasaki, Kyoto (JP); Hirofumi Yoneda, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 0 days.

(21) Appl. No.: 17/967,935

(22) Filed: Oct. 18, 2022

(65) Prior Publication Data

US 2023/0120451 A1 Apr. 20, 2023

(30) Foreign Application Priority Data

Oct. 19, 2021 (JP) ..... 2021-170663
Oct. 19, 2021 (JP) ..... 2021-170664
Oct. 19, 2021 (JP) ..... 2021-170665

(51) Int. Cl.

| | |
|---|---|
| ***F04D 29/06*** | (2006.01) |
| ***F04D 29/52*** | (2006.01) |
| ***F04D 19/00*** | (2006.01) |
| ***F04D 29/64*** | (2006.01) |
| ***F04D 25/06*** | (2006.01) |

(52) U.S. Cl.

CPC ..... *F04D 29/526* (2013.01); *F04D 19/002* (2013.01); *F04D 25/0613* (2013.01); *F04D 29/522* (2013.01); *F04D 29/64* (2013.01); *F04D 29/646* (2013.01)

(58) Field of Classification Search

CPC .... F04D 25/0613; F04D 29/52; F04D 29/522; F04D 29/526; F04D 29/64; F04D 29/644; F04D 29/646; F04D 19/007

See application file for complete search history.

(56) References Cited

U.S. PATENT DOCUMENTS 7,156,611 B2 * 1/2007 Oosawa ..... F04D 19/007 415/199.5
7,445,423 B2 * 11/2008 Ishihara ..... F04D 19/024 415/214.1
7,585,150 B2 * 9/2009 Hsu ..... F04D 29/646 415/214.1

(Continued)

FOREIGN PATENT DOCUMENTS

JP 2020-105974 A 7/2020

*Primary Examiner* — Justin D Seabe
*Assistant Examiner* — Behnoush Haghighian
(74) *Attorney, Agent, or Firm* — Keating & Bennett, LLP

(57) ABSTRACT

A motor includes a rotor rotatable about a center axis extending vertically, a stator to rotate the rotor, and a housing covering the rotor and the stator from a radially outer side. The housing includes a first housing located on a first side in the axial direction, and a second housing located on a second side in the axial direction. The first housing includes a first opposing surface opposing the second housing in the axial direction, and a first wall portion extending from the first opposing surface to the second side in the axial direction. The second housing includes a second opposing surface opposing the first housing in the axial direction, a second wall portion extending from the second opposing surface to the first side in the axial direction, and a base portion holding the stator. The first wall portion and the second wall portion oppose each other in a radial direction.

16 Claims, 20 Drawing Sheets

(56) References Cited

U.S. PATENT DOCUMENTS 7,909,568 B2 * 3/2011 Ishihara ..... F04D 29/626 415/214.1
8,123,461 B2 * 2/2012 Yoshida ..... F04D 19/007 415/214.1
8,133,006 B2 * 3/2012 Yoshida ..... F04D 25/0613 415/68
8,251,641 B2 * 8/2012 Hsu ..... F04D 29/646 415/213.1
8,277,178 B2 * 10/2012 Li ..... F04D 29/646 415/214.1
9,670,932 B2 * 6/2017 Iwamoto ..... F04D 29/522
9,897,094 B2 * 2/2018 Kang ..... F04D 29/522
10,408,216 B2 * 9/2019 Takeshita ..... H02K 7/14
11,221,023 B2 * 1/2022 Ma ..... F04D 29/522
11,319,970 B2 * 5/2022 Masuo ..... F04D 19/007
2007/0003413 A1 * 1/2007 Hsu ..... F04D 29/646 415/199.5
2007/0059155 A1 * 3/2007 Ishihara ..... F04D 19/024 415/60
2007/0117465 A1 * 5/2007 Horng ..... F04D 25/0613 439/660
2008/0260526 A1 * 10/2008 Nishizawa ..... F04D 25/0613 415/199.4
2009/0047118 A1 * 2/2009 Ishihara ..... F04D 19/024 415/60
2009/0111372 A1 * 4/2009 Hsu ..... F04D 29/646 454/193
2009/0214336 A1 * 8/2009 Yoshida ..... F04D 29/646 415/214.1
2009/0214337 A1 * 8/2009 Yoshida ..... F04D 25/0613 415/214.1
2009/0246015 A1 * 10/2009 Hsu ..... F04D 19/007 415/213.1
2015/0023786 A1 * 1/2015 Li ..... F04D 29/668 415/199.4
2017/0321707 A1 * 11/2017 Takeshita ..... F04D 29/325
2018/0335049 A1 * 11/2018 Gu ..... F04D 29/541

* cited by examiner

MOTOR AND AXIAL FAN

CROSS-REFERENCE TO RELATED APPLICATIONS

The present application claims priority under 35 U.S.C. § 119 to Japanese Patent Application No. 2021-170665, filed on Oct. 19, 2021, Japanese Patent Application No. 2021-170663, filed on Oct. 19, 2021, and Japanese Patent Application No. 2021-170664, filed on Oct. 19, 2021, the entire contents of which are hereby incorporated herein by reference.

1. FIELD OF THE INVENTION

The present disclosure relates to a motor and an axial fan.

2. BACKGROUND

A conventional motor includes a first housing and a second housing. The first housing and the second housing are overlapped with each other in the axial direction. A bearing holder to which a stator core and the like are attached is located in the second housing.

Further, the lead wire of the motor is drawn out to the radially outer side of the housing from between the first housing and the second housing.

In the above-described conventional configuration, the bearing holder is provided in the second housing and is not provided in the first housing. Therefore, the first housing has lower strength than the second housing. Therefore, there is a possibility that the first housing is deformed.

Further, in the above conventional configuration, each of the first housing and the second housing has a through-hole connected to each other in the axial direction. Then, the housing is fixed to another member by a fastening member inserted into the through-hole. In this configuration, when the housing is fixed by the fastening member, the fastening member comes into contact with the inner peripheral surface of the through-hole, and the housing may be deformed.

Further, in the above conventional configuration, the lead wire is sandwiched between the first housing and the second housing. Therefore, the lead wire can be held so that the position of the lead wire does not deviate. However, since a load is applied to the lead wire between the first housing and the second housing, there is a possibility that it becomes difficult to fix the lead wire when an operation of fixing the lead wire to the radially outer surface of the housing is performed.

SUMMARY

A motor according to an example embodiment of the present disclosure includes a rotor that is rotatable about a center axis extending vertically, a stator to rotate the rotor, and a housing that covers the rotor and the stator from a radially outer side. The housing includes a first housing located on a first side in an axial direction and a second housing located on a second side in the axial direction. The first housing includes a first opposing surface opposing the second housing in the axial direction, and a first wall portion extending from the first opposing surface to another side in the axial direction. The second housing includes a second opposing surface opposing the first housing in the axial direction, a second wall portion extending from the second opposing surface to one side in the axial direction, and a base portion holding the stator. The first wall portion and the second wall portion oppose each other in a radial direction.

A motor according to an example embodiment of the present disclosure includes a rotor that is rotatable about a center axis extending vertically, a stator to rotate the rotor, and a housing that covers the rotor and the stator from a radially outer side. The housing includes a first housing located on a first side in an axial direction and a second housing located on a second side in the axial direction. The housing includes a through-hole passing therethrough in the axial direction. The through-hole includes a first through-hole located in the first housing and a second through-hole located in the second housing. At least one of the first through-hole and the second through-hole includes a small-diameter portion and a large-diameter portion including a larger hole diameter than the small-diameter portion.

A motor according to an example embodiment of the present disclosure includes a rotor that is rotatable in a circumferential direction about a center axis extending vertically, a stator to rotate the rotor, a lead wire that is electrically connected to the stator, and a housing that covers the rotor and the stator from a radially outer side. The housing includes a first housing located on a first side in an axial direction and a second housing located on a second side in the axial direction. The first housing includes a wiring convex portion protruding toward the second side in the axial direction, and the second housing includes a wiring recess that is recessed toward the second side in the axial direction and penetrates in the radial direction. The wiring convex portion is located in the wiring recess. The wiring convex portion includes a tip surface opposing the second side in the axial direction. The wiring recess includes a bottom surface opposing one side in the axial direction. The lead wire is located between the tip surface and the bottom surface when viewed from the radial direction. At least a portion of the tip surface is located at a position shifted in the radial direction from a position opposing the bottom surface in the axial direction.

An axial fan according to an example embodiment of the present disclosure includes the motor and a rotor blade attached to the rotor.

The above and other elements, features, steps, characteristics and advantages of the present disclosure will become more apparent from the following detailed description of the example embodiments with reference to the attached drawings.

DETAILED DESCRIPTION

Example embodiments of the present disclosure will be described below with reference to the accompanying drawings.

In the present specification, a direction in which a center axis CA of a motor 100 extends is referred to as an "axial direction", and the axial direction is referred to as a vertical direction. However, the definition of the vertical direction does not limit the orientation and positional relationship when the motor 100 is used.

In the present specification, one orientation in the axial direction is referred to as "upward", and the other orientation in the axial direction is referred to as "downward". In each component, an end surface opposing upward in the upper end portion is referred to as an "upper end surface", and an end surface opposing downward in the lower end portion is referred to as a "lower end surface".

In the present specification, a direction orthogonal to the center axis CA is referred to as a "radial direction". In the radial direction, an orientation approaching the center axis CA is referred to as "radially inner side", and an orientation separating from the center axis CA is referred to as "radially outer side". In each component, a side surface opposing the radially inner side is referred to as a "radially inner surface", and a side surface opposing the radially outer side is referred to as a "radially outer surface".

In the present specification, a circumferential direction centered on the center axis CA is referred to as a "circumferential direction".

Figure 1:
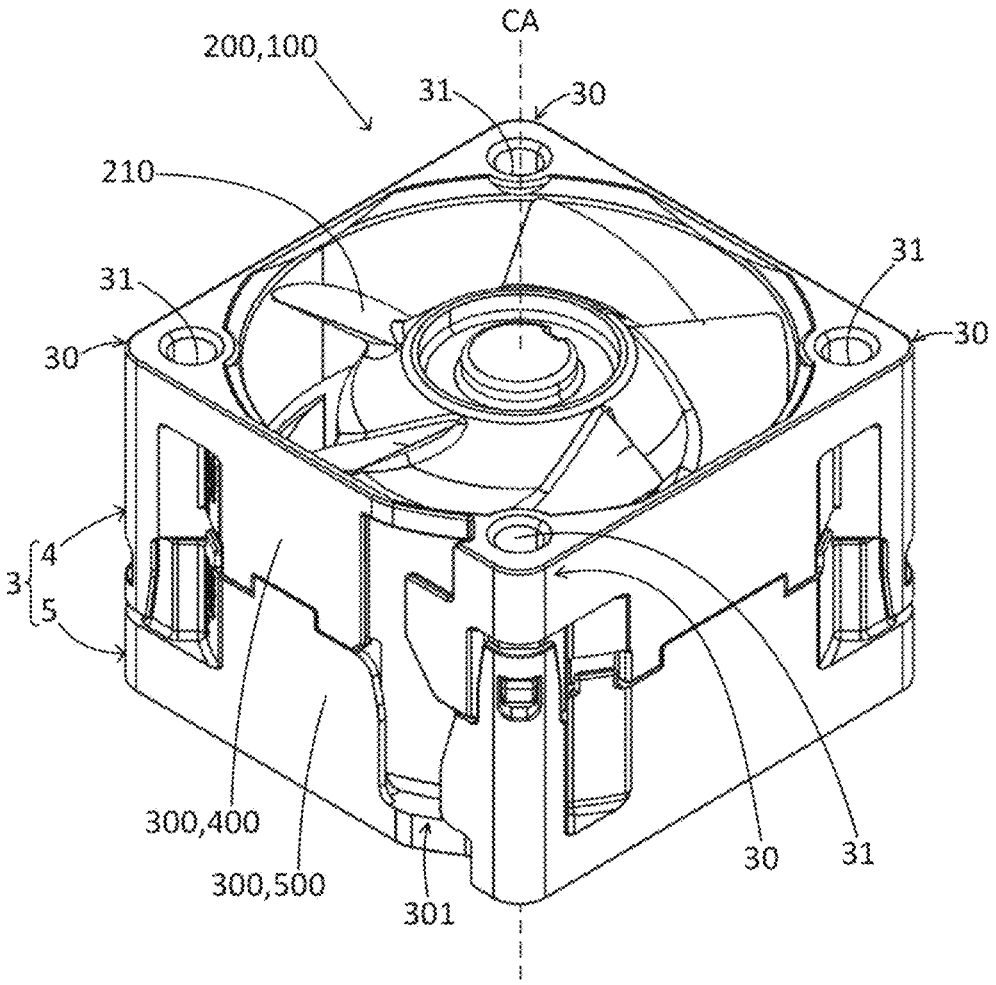
FIG. 1 is a perspective view of an axial fan according to first, second, and third example embodiments of the present disclosure.
Figure 2:
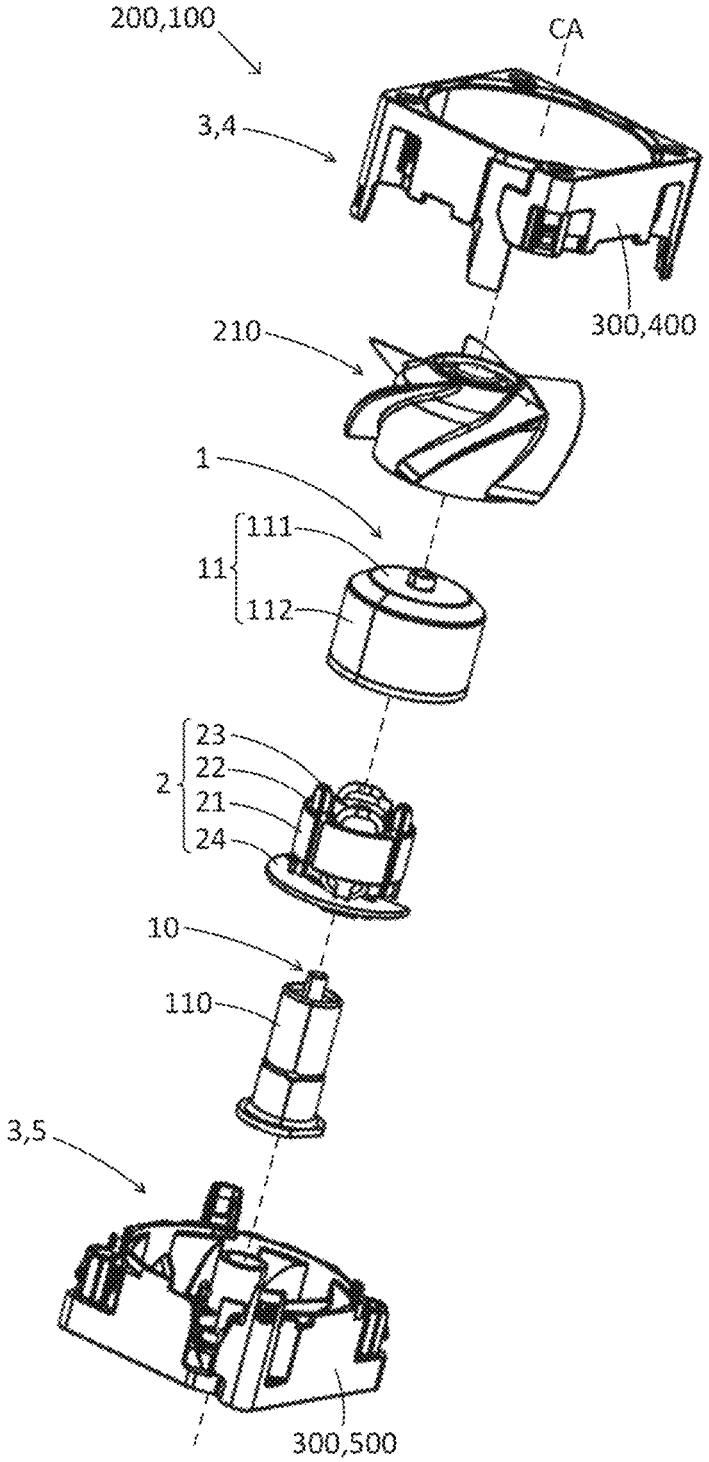
FIG. 2 is an exploded perspective view of the axial fan according to the first, second, and third example embodiments.

FIG. 1 is a perspective view of an axial fan 200 according to an example embodiment. FIG. 2 is an exploded perspective view of the axial fan 200 according to the example embodiment.

The axial fan 200 generates an air flow. The axial fan 200 includes a motor 100 and a rotor blade 210. The motor 100 is an outer rotor type. The rotor blade 210 is attached to the motor 100. Specifically, the rotor blade 210 are attached to the rotor 1 described later. The motor 100 rotates the rotor blade 210. When the rotor blade 210 rotate, an air flow is generated.

The motor 100 includes a rotor 1, a stator 2, and a housing 3. The motor 100 includes a shaft 10.

The shaft 10 is located along the center axis CA extending vertically. The shaft 10 is supported by a shaft holder 110. The shaft holder 110 extends in a tubular shape in the axial direction along the center axis CA. A bearing (not illustrated) that rotatably supports the shaft 10 is attached to a radially inner surface of the shaft holder 110.

The rotor 1 is rotatable about a center axis CA extending vertically. The rotor 1 has a covered cylindrical yoke 11. A yoke lid 111, which is a lid of the yoke 11, has a disk shape centered on the center axis CA. The yoke lid 111 has an opening at the center in the radial direction. The shaft 10 is fixed to a radially inner surface of the opening of the yoke lid 111. A yoke cylindrical portion 112, which is a cylindrical portion of the yoke 11, extends downward from the radially outer edge of the yoke lid 111. A magnet (not illustrated) is fixed to a radially inner surface of the yoke cylindrical portion 112.

The stator 2 rotates the rotor 1. The stator 2 has an annular shape centered on the center axis CA extending vertically, and is located on the radially inner side of the rotor 1. The radially outer surface of the stator 2 faces the radially inner surface of the rotor 1. Specifically, the radially outer surface of the stator 2 faces the magnet fixed to the radially inner surface of the yoke 11. The radially inner surface of the stator 2 is fixed to the radially outer surface of the shaft holder 110.

The stator 2 includes a stator core 21, an insulator 22, a coil 23, and a circuit board 24. The stator core 21 is an annular magnetic body centered on the center axis CA, and is a laminate in which a plurality of plate-shaped electromagnetic steel sheets are laminated in the axial direction. The radially outer surface of the stator core 21 faces the magnet in the radial direction. The radially inner surface of the stator core 21 is fixed to the radially outer surface of the shaft holder 110.

The insulator 22 covers at least a part of the stator core 21. The insulator 22 is an insulating member using resin or the like. The coil 23 is formed by winding a conductive wire around the stator core 21 through the insulator 22. The circuit board 24 is electrically connected to the coil 23. Various electronic components are mounted on the circuit board 24.

The housing 3 covers the rotor 1 and the stator 2 from the radially outer side. The housing 3 covers the rotor blade 210 attached to the rotor 1 from the radially outer side.

Figure 6:
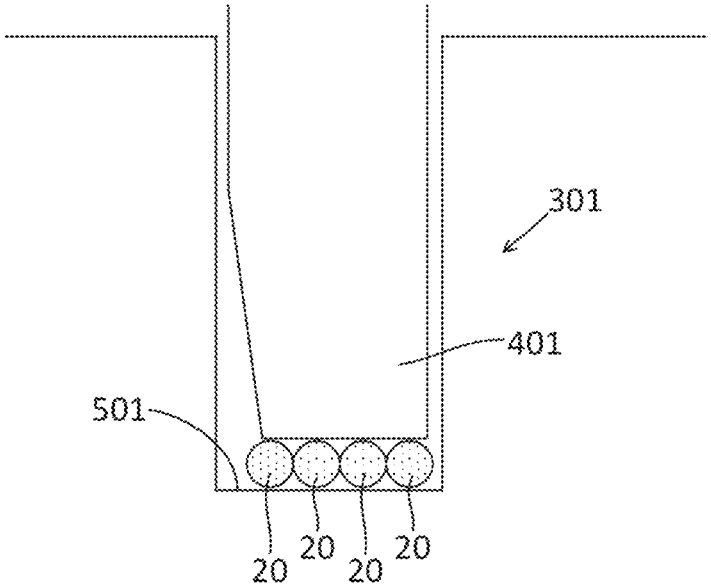
FIG. 6 is a schematic view illustrating a lead wire holding structure by the housing according to the first and second example embodiments.

The motor 100 includes a lead wire 20 (see FIG. 6). The lead wire 20 is electrically connected to the stator 2. Specifically, the plurality of lead wires 20 are connected to the circuit board 24. The lead wire 20 is drawn out from the inside to the outside of the motor 100. That is, the lead wire 20 is drawn out to the radially outer side from the radially inner side of the housing 3.

Figure 3:
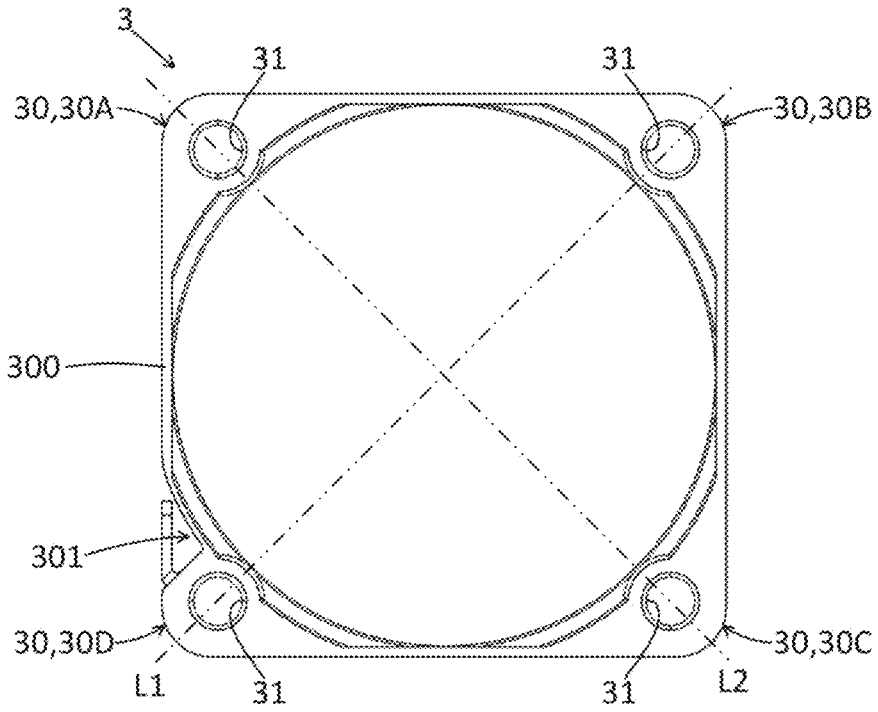
FIG. 3 is a plan view of a housing according to the first and second example embodiments as viewed from the axial direction.
Figure 4:
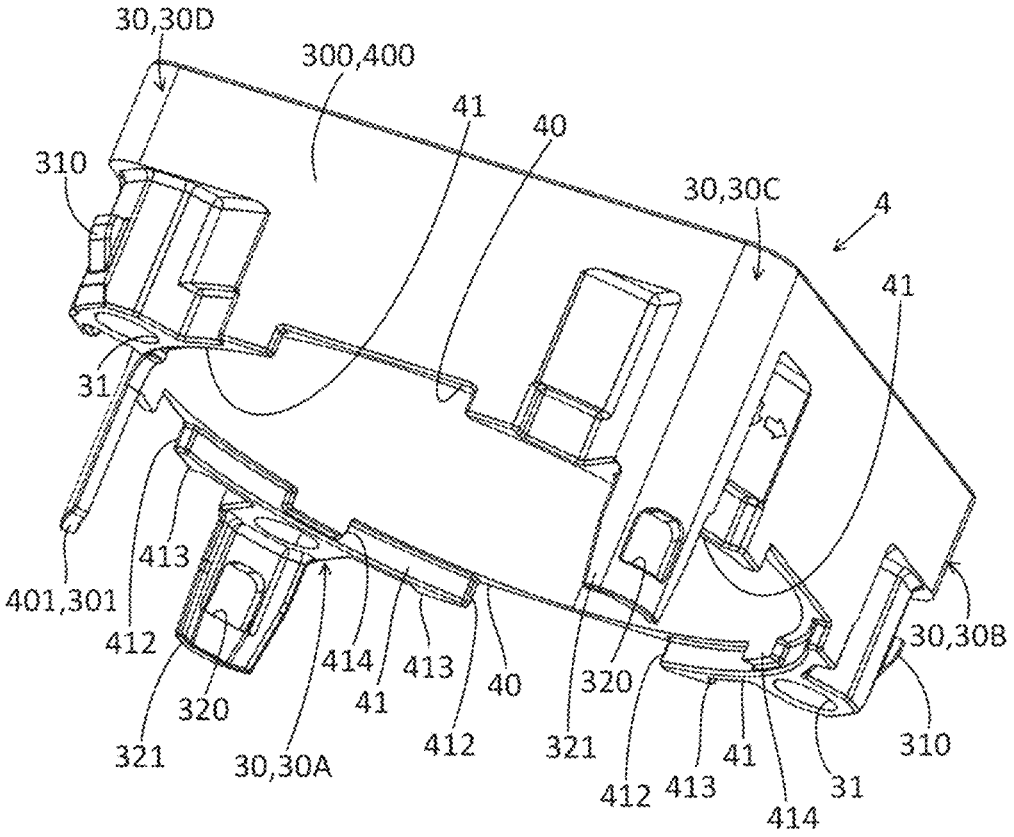
FIG. 4 is a perspective view of a first housing according to the first and second example embodiments.
Figure 5:
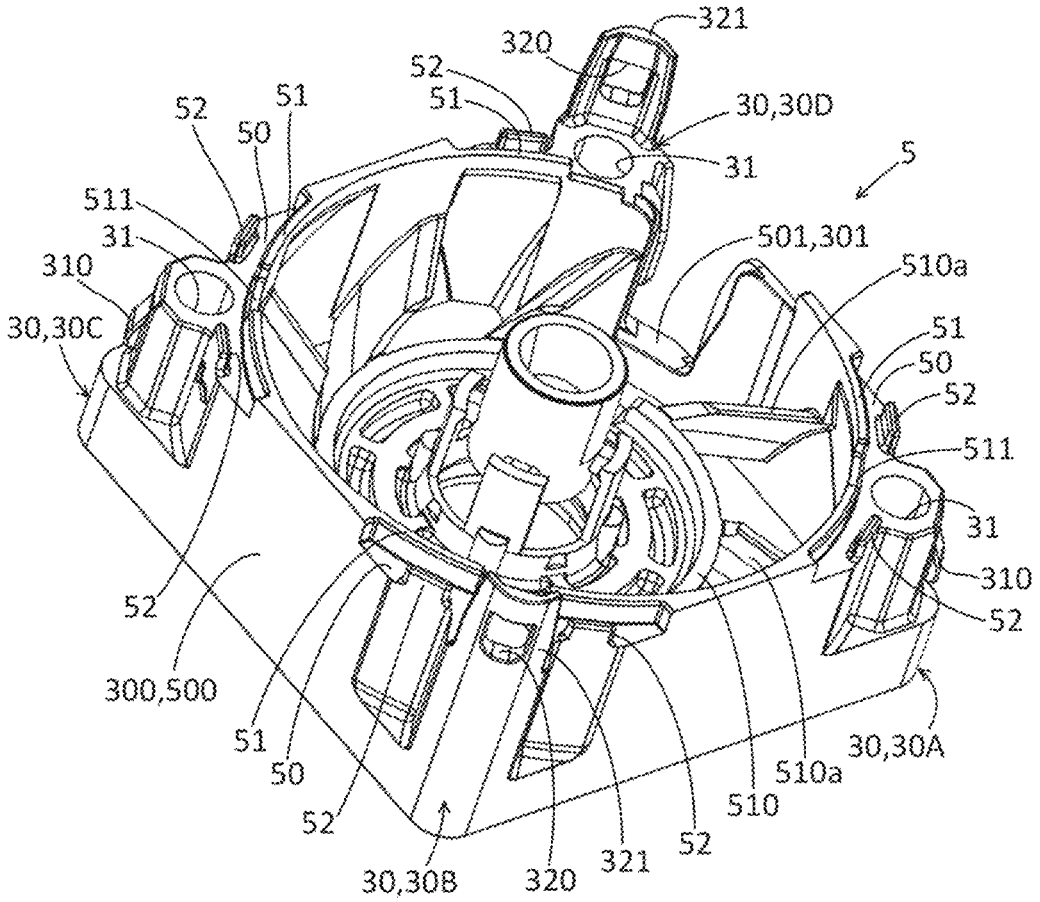
FIG. 5 is a perspective view of a second housing according to the first and second example embodiments.

FIG. 3 is a plan view of the housing 3 according to the example embodiment as viewed from the axial direction. In FIG. 3, each portion located on the radially inner side of a cylindrical portion 300 is not illustrated. In FIG. 3, a diagonal connecting vertexes of the housing 3 in a plan view is indicated by a two-dot chain line. Hereinafter, this diagonal is simply referred to as a diagonal of the housing 3. A diagonal of the housing 3 is a line connecting vertexes of a pair of corners 30 located opposite to each other across the center axis CA. FIG. 4 is a perspective view of a first housing 4 according to the example embodiment. FIG. 5 is a perspective view of a second housing 5 according to the example embodiment. FIG. 6 is a schematic view illustrating a holding structure of the lead wire 20 by the housing 3 according to the example embodiment. In FIG. 6, the lead wire 20 is shown in cross section.

The housing 3 includes the first housing 4 and the second housing 5. The first housing 4 is located on one side in the axial direction. The second housing 5 is located on the other side in the axial direction. That is, the first housing 4 is located on the upper side. The second housing 5 is located on the lower side. The first housing 4 and the second housing 5 are joined to each other in the axial direction.

The housing 3 has the cylindrical portion 300 centered on the center axis CA. That is, each of the first housing 4 and the second housing 5 has the cylindrical portion 300 centered on the center axis CA. The cylindrical portions 300 of the first housing 4 and the second housing 5 are joined to each other in the axial direction. In the following description, when it is necessary to distinguish the cylindrical portions 300 of the first housing 4 and the second housing 5, the cylindrical portion 300 of the first housing 4 is denoted by reference numeral 400 and is referred to as a first cylindrical portion 400, and the cylindrical portion 300 of the second housing 5 is denoted by reference numeral 500 and is referred to as a second cylindrical portion 500.

The cylindrical portion 300 covers the rotor 1 and the stator 2 from the radially outer side. The rotor blade 210 are attached to the rotor 1. Therefore, the rotor blade 210 is covered by the cylindrical portion 300 from the radially outer side. The cylindrical portion 300 guides the airflow generated by the rotation of the rotor blade 210 in the axial direction.

The outer shape of the housing 3 is a quadrangular shape having four corners 30 when viewed from the axial direction. Each corner 30 may be rounded. For example, each corner 30 has an R-chamfered shape. However, each corner 30 may have a right angle shape. Each corner 30 may have a C-chamfered shape. In the following description, when it is necessary to distinguish the four corners 30, reference signs 30A, 30B, 30C, and 30D are attached to the four corners 30, respectively.

The corner 30 has a through-hole 31 penetrating in the axial direction. One through-hole 31 is provided in each of the four corners 30. The through-hole 31 is located on a diagonal of the housing 3. A fastening member (not illustrated) such as a screw is inserted into the through-hole 31. The housing 3 is fixed to another member (not illustrated) by the fastening member.

The first housing 4 has a first opposing surface 40 axially opposing the second housing 5. The second housing 5 has a second opposing surface 50 axially opposing the first housing 4. Specifically, the first cylindrical portion 400 and the second cylindrical portion 500 have the first opposing surface 40 and the second opposing surface 50, respectively. The first cylindrical portion 400 has the first opposing surface 40 on a lower end surface thereof, and the second cylindrical portion 500 has the second opposing surface 50 on an upper end surface thereof.

The second housing 5 holds the shaft holder 110. In other words, the second housing 5 holds the stator 2. Specifically, the second housing 5 has a base portion 510 that holds the stator 2. For example, the base portion 510 is the same member as the second housing 5, and is formed integrally with the second housing 5.

The base portion 510 has a disk shape centered on the center axis CA. The shaft holder 110 is fixed to the radial center of the base portion 510. The base portion 510 has a plurality of connection portions 510*a* extending to the radially outer side from the radially outer surface. The connection portion 510*a* is connected to the radially inner surface of the second cylindrical portion 500. In other words, the connection portion 510*a* connects the base portion 510 and the second cylindrical portion 500.

The second cylindrical portion 500 has relatively high strength because the base portion 510 is connected via the connection portion 510*a*. On the other hand, a member corresponding to the base portion 510 is not connected to the first cylindrical portion 400. Therefore, the second cylindrical portion 500 has higher strength than the first cylindrical portion 400. In other words, the second cylindrical portion 500 is less likely to be deformed than the first cylindrical portion 400.

The cylindrical portion 300 has a wiring portion 301 in which the lead wire 20 is located. Specifically, the first housing 4 has a wiring convex portion 401 in the first cylindrical portion 400, and the second housing 5 has a wiring recess 501 in the second cylindrical portion 500.

The wiring convex portion 401 extends downward from the lower end surface of the first cylindrical portion 400. On the other hand, the wiring recess 501 is recessed downward from the upper end surface of the second cylindrical portion 500 and penetrates the second cylindrical portion 500 in the radial direction. The wiring convex portion 401 is located in the wiring recess 501.

The wiring portion 301 includes the wiring convex portion 401 and the wiring recess 501 (see FIG. 6). Specifically, the wiring portion 301 is constituted by a gap between the tip portion of the wiring convex portion 401 and the bottom portion of the wiring recess 501 in the axial direction. The lead wire 20 is located in a gap between the tip portion of the wiring convex portion 401 and the bottom of the wiring recess 501 in the axial direction. In other words, the through-hole for wiring is formed by the gap between the tip portion of the wiring convex portion 401 and the bottom of the wiring recess 501 in the axial direction. The lead wire 20 is drawn out to the radially outer side from the radially inner side of the housing 3 through the through-hole.

Figure 7:
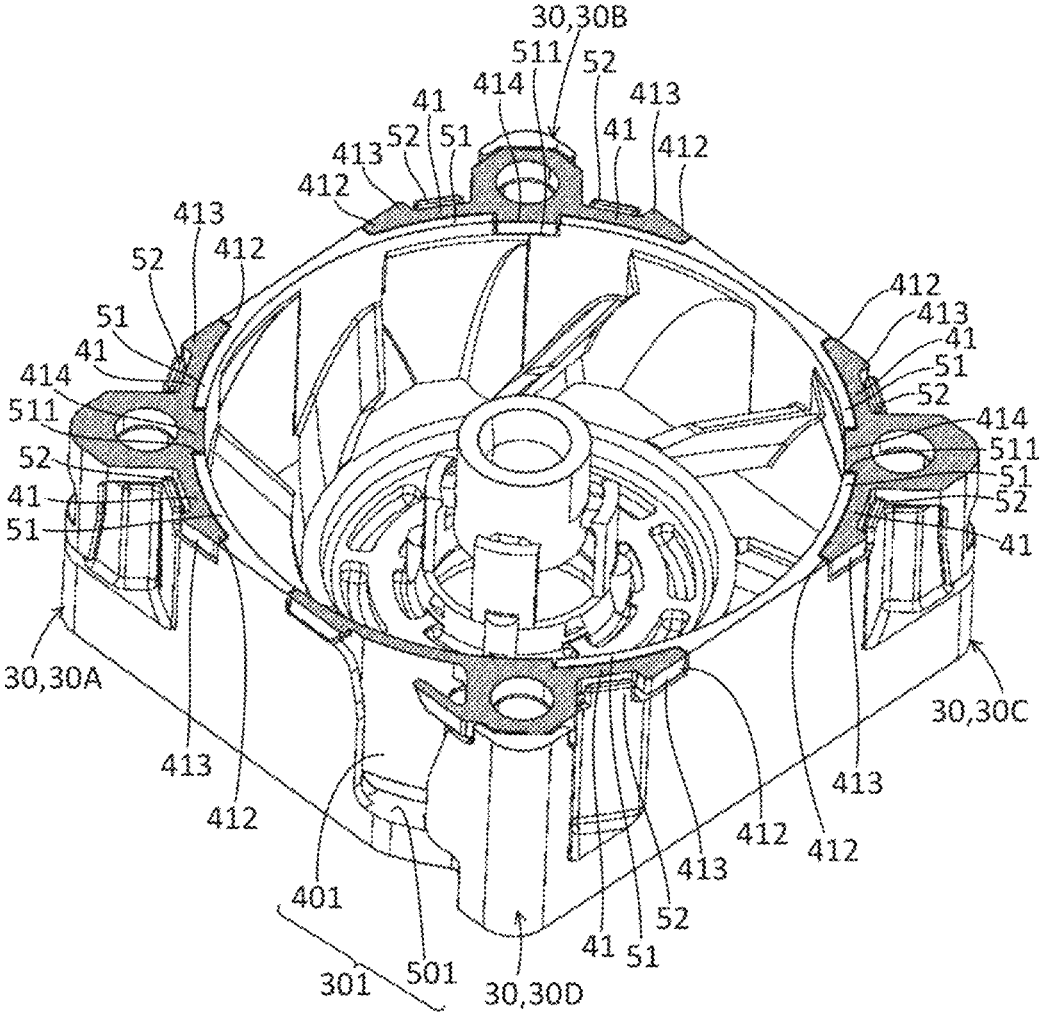
FIG. 7 is a cross-sectional view of the housing according to the first and second example embodiments.
Figure 8:
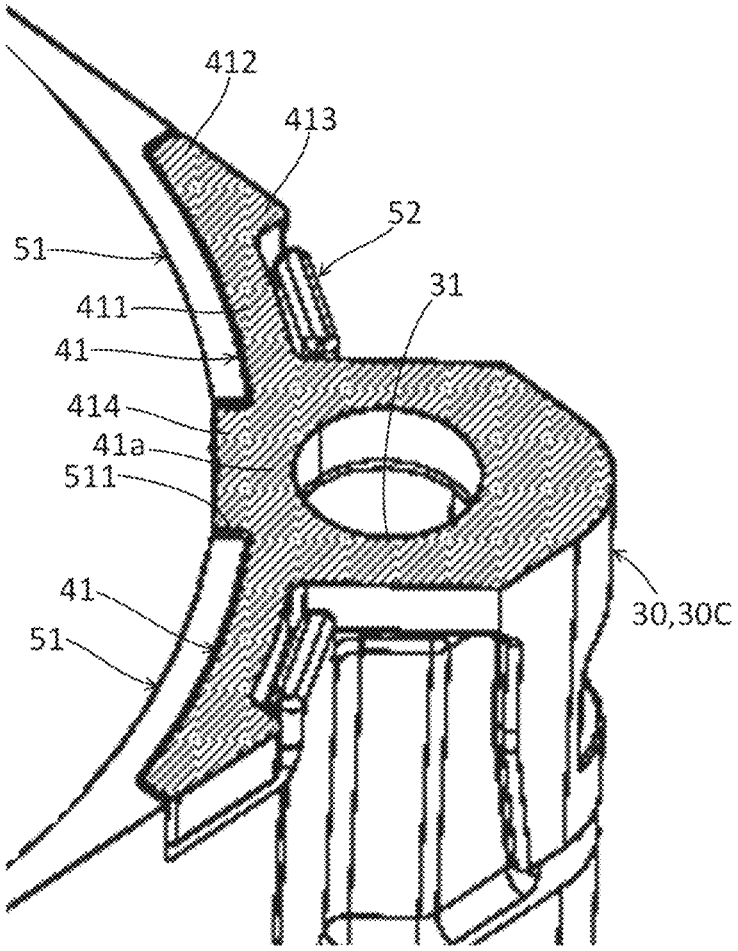
FIG. 8 is an enlarged view of the periphery of a corner illustrated in FIG. 7.

FIG. 7 is a cross-sectional view of the housing 3 according to the example embodiment. FIG. 7 is a cross-sectional view of the first housing 4 fixed to the second housing 5 taken along a plane parallel to the radial direction. FIG. 8 is an enlarged view of the periphery of the corner 30 illustrated in FIG. 7.

The first housing 4 has a first wall portion 41 extending from the first opposing surface 40 to the other side in the axial direction. The first wall portion 41 extends downward from the first opposing surface 40. That is, the first wall portion 41 extends from the first opposing surface 40 toward the second housing 5.

The second housing 5 has a second wall portion 51 extending from the second opposing surface 50 to one side in the axial direction. The second wall portion 51 extends upward from the second opposing surface 50. That is, the second wall portion 51 extends from the second opposing surface 50 toward the first housing 4.

The first wall portion 41 and the second wall portion 51 oppose each other in the radial direction. As a result, even if the first housing 4 having a strength lower than that of the second housing 5 attempts to deform in the radial direction, the deformation of the first housing 4 can be restricted by the second wall portion 51. That is, deformation of the first housing 4 can be suppressed. As a result, deformation of the housing 3 can be suppressed.

The first wall portion 41 is located at any one of the corners 30. Here, in the configuration in which the outer shape of the housing 3 is a quadrangular shape, the thickness of the corner 30 of the housing 3 is larger than the thickness of the other portion. Therefore, it is preferable to dispose the first wall portion 41 at any corner 30 of the housing 3. That is, the first wall portion 41 is preferably located at any corner 30 of the first housing 4. Accordingly, the thickness of the first wall portion 41 can be increased. As a result, the strength of the first wall portion 41 can be sufficiently secured.

The first wall portion 41 is located at each of a pair of corners 30 located on a diagonal of the housing 3. Accordingly, deformation of the first housing 4 can be further suppressed. The first wall portion 41 may be located at corners 30A and 30C located on one diagonal, or may be located at the corners 30B and 30D located on the other diagonal. The first wall portion 41 may be located at all the corners 30.

The first wall portion 41 is connected to a radially inner portion of the outer edge portion of the through-hole 31. In other words, the first wall portion 41 has a connection portion 41*a* (see FIG. 8) connected to the outer edge portion of the through-hole 31, and extends in the circumferential direction from the connection portion 41*a*.

For example, the first wall portions 41 located at the corners 30A, 30B, and 30C extend from the connection portions 41*a* to one side and the other side in the circumferential direction. On the other hand, the first wall portion 41 arranged at the corner 30D extends from the connection portion 41*a* to one side in the circumferential direction, but does not extend to the other side in the circumferential direction. The wiring portion 301 is provided on the other side in the circumferential direction with respect to the connection portion 41*a* of the first wall portion 41 arranged at the corner 30D.

The first wall portion 41 and the second wall portion 51 are in contact with each other in the radial direction. With this configuration, deformation of the first housing 4 can be further suppressed.

Here, the rotor blade 210 that rotates about the center axis CA is located on the radially inner side of the housing 3. In this configuration, when the first housing 4 is deformed to the radially inner side, there is a possibility that the first housing 4 comes into contact with the rotor blade 210. That is, there is a possibility that the housing 3 comes into contact with the rotor blade 210.

Therefore, the second wall portion 51 is located on the radially inner side of the first wall portion 41. The radially inner surface of the first wall portion 41 contacts the radially outer surface of the second wall portion 51. As a result, the first housing 4 can be prevented from being deformed to the radially inner side. That is, it is possible to suppress the radially inner side deformation of the housing 3. If the radially inner side deformation of the housing 3 can be suppressed, the housing 3 can be suppressed from coming into contact with the rotor blade 210.

The second housing 5 further includes a third wall portion 52 extending from the second opposing surface 50 to one side in the axial direction. The third wall portion 52 extends upward from the second opposing surface 50. That is, the third wall portion 52 extends from the second opposing surface 50 toward the first housing 4.

The third wall portion 52 is located on the radially outer side of the first wall portion 41. The first wall portion 41 and the third wall portion 52 oppose each other in the radial direction. As a result, even if the first housing 4 having a strength lower than that of the second housing 5 attempts to deform to the radially outer side, the deformation of the first housing 4 can be restricted by the third wall portion 52. That is, it is possible to suppress the radially outward deformation of the first housing 4. As a result, it is possible to suppress the radially outward deformation of the housing 3.

Further, the third wall portion 52 faces the second wall portion 51 in the radial direction with the first wall portion 41 interposed therebetween. That is, at least a part of the first wall portion 41 is located between the second wall portion 51 and the third wall portion 52 in the radial direction. As a result, a labyrinth structure is formed in a region where the first wall portion 41 is located between the second wall portion 51 and the third wall portion 52 in the radial direction. As a result, in addition to the suppression of the change of the first housing 4 in the radial direction, it is possible to suppress the air from leaking out in the radial direction from the interface between the first housing 4 and the second housing 5.

A part of the first wall portion 41 does not face the third wall portion 52 in the radial direction. Specifically, the first wall portion 41 has an overlapping portion 411 (see FIG. 8) overlapping the third wall portion 52 in the radial direction. On the other hand, the first wall portion 41 also has a portion that does not overlap the third wall portion 52 in the radial direction. In other words, the first wall portion 41 has a circumferential end portion 412 protruding in the circumferential direction from the overlapping portion 411. The circumferential end portion 412 is a non-overlapping portion that does not overlap the third wall portion 52 in the radial direction.

The circumferential end portion 412 has a protruding portion 413 protruding to the radially outer side. For example, the protruding portion 413 protrudes to the radially outer side from the radially outer surface of the third wall portion 52. The protruding portion 413 faces a surface of the third wall portion 52 opposing the circumferential direction. That is, the protruding portion 413 has a surface opposing the surface opposing the circumferential direction of the third wall portion 52.

The circumferential positioning of the first housing 4 can be performed by making the surface of the third wall portion 52 opposing the circumferential direction and the protruding portion 413 oppose each other. The first housing 4 can be prevented from being deformed in the circumferential direction. The surface of the third wall portion 52 opposing the circumferential direction may be in contact with the protruding portion 413. In this case, it is possible to further suppress deformation of the first housing 4 in the circumferential direction.

The first wall portion 41 has a convex portion 414 protruding to the radially inner side. The convex portion 414 protrudes to the radially inner side from the overlapping portion 411. The second wall portion 51 has a recess 511. The recess 511 is recessed toward the other side in the axial direction. Specifically, the recess 511 is recessed downward from the upper end surface of the second wall portion 51. The recess 511 penetrates the second wall portion 51 in the radial direction.

The convex portion 414 is located in the recess 511. That is, the outer surface of the convex portion 414 opposing the circumferential direction faces the inner surface of the recess 511 opposing the circumferential direction. The outer surface of the convex portion 414 may contact the inner surface of the recess 511. Thus, the first housing 4 can be located in the circumferential direction. When the outer surface of the convex portion 414 and the inner surface of the recess 511 are in contact with each other, the first housing 4 can be further prevented from being deformed in the circumferential direction.

The convex portion 414 is located at the connection portion 41*a* (see FIG. 8). In other words, the convex portion 414 protrudes to the radially inner side from a radially inner portion of the outer edge portion of the through-hole 31. Therefore, the thickness of the radially inner portion of the outer edge portion of the through-hole 31 increases by the amount of the convex portion 414 protruding to the radially inner side. As a result, the strength of the outer edge portion of the through-hole 31 can be increased.

Figure 9:
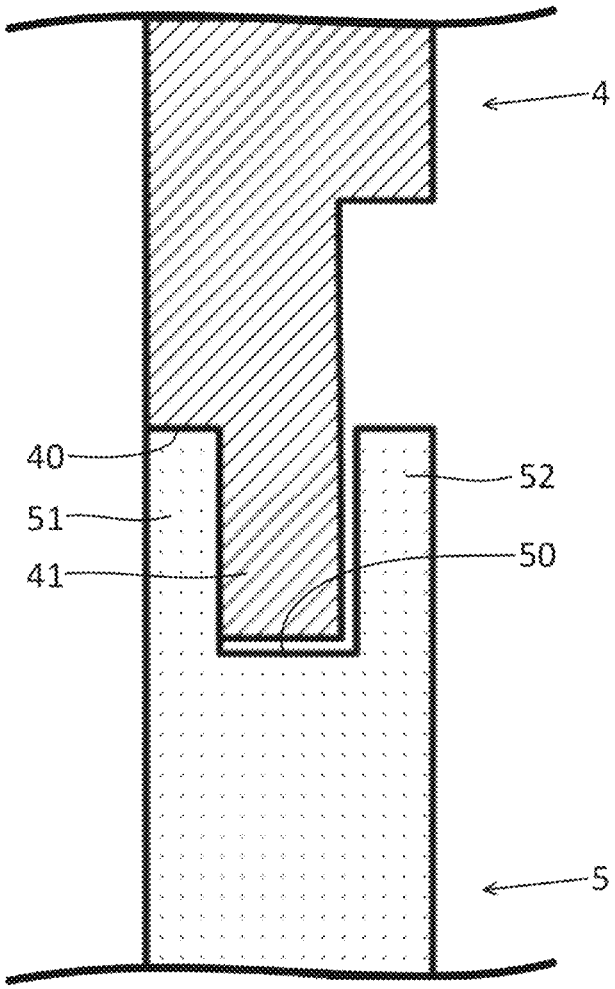
FIG. 9 is a schematic view illustrating an enlarged axial positioning structure of the first housing according to the first example embodiment.
Figure 10:
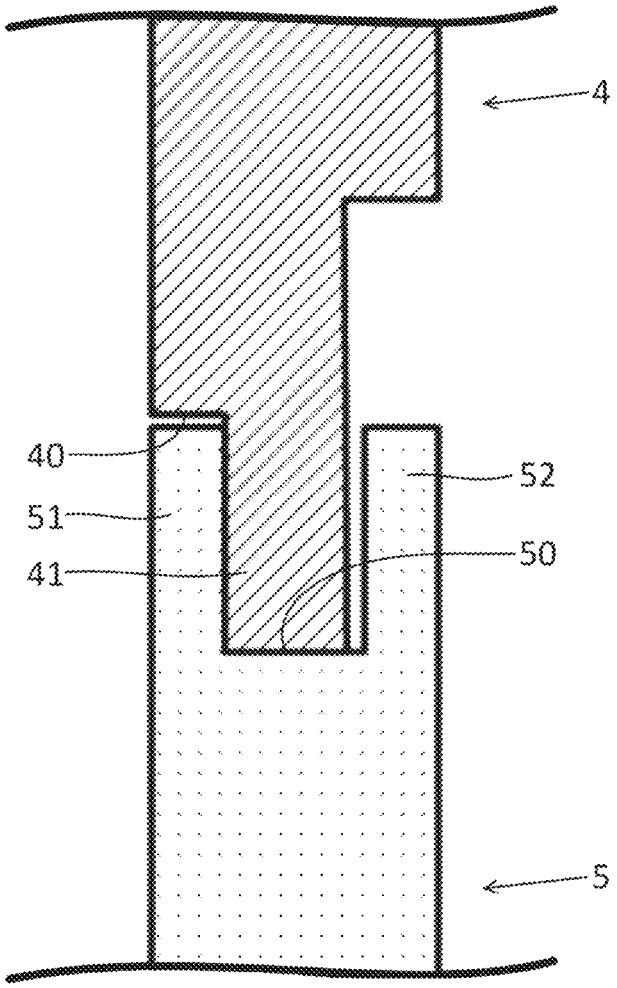
FIG. 10 is a schematic view illustrating an enlarged axial positioning structure of a first housing according to a first modification of an example embodiment of the present disclosure.

FIG. 9 is an enlarged schematic view illustrating an axial positioning structure of the first housing 4 according to the example embodiment. FIG. 10 is an enlarged schematic view illustrating an axial positioning structure of the first housing 4 according to a modification.

An end surface of the second wall portion 51 opposing one side in the axial direction is in contact with the first opposing surface 40 (see FIG. 9). That is, the upper end surface of the second wall portion 51 is in contact with the first opposing surface 40. For example, the upper end surface of the second wall portion 51 is in contact with the first opposing surface 40 over the entire surface. As a result, the first housing 4 is located in the axial direction, and the first housing 4 can be suppressed from being displaced in the axial direction with respect to the second housing 5.

It is possible to suppress generation of a gap at a joint portion between the first housing 4 and the second housing on the inner peripheral surface of the cylindrical portion 300 of the housing 3. When there is a gap at the joint portion between the first housing 4 and the second housing, the air flow generated on the radially inner side of the cylindrical portion 300 is affected by being disturbed. However, when there is no gap at the joint portion between the first housing 4 and the second housing 5, the air flow generated on the radially inner side of the cylindrical portion 300 can be suppressed from being affected. As a result, the blowing efficiency of the axial fan 200 is improved.

The configuration of the modification illustrated in FIG. 10 may be adopted with respect to the axial positioning of the first housing 4. In the modification, the end surface of the second wall portion 51 opposing one side in the axial direction is not in contact with the first opposing surface 40. On the other hand, an end surface of the first wall portion 41 opposing the other side in the axial direction is in contact with the second opposing surface 50. That is, the lower end surface of the first wall portion 41 is in contact with the second opposing surface 50. For example, the lower end surface of the first wall portion 41 is in contact with the second opposing surface 50 over the entire surface. Even when the configuration of the modification illustrated in FIG. 10 is adopted, the first housing 4 is located in the axial direction, and the first housing 4 can be suppressed from being displaced in the axial direction with respect to the second housing 5.

The first housing 4 has at least one of an engagement claw 310 protruding in the radial direction and an engagement hole 320 engaged with the engagement claw 310 (see FIG. 4). The second housing 5 has at least the other one of the engagement claw 310 and the engagement hole 320 (see FIG. 5). The engagement claw 310 protrudes to the radially outer side. The engagement hole 320 penetrates in the radial direction.

When the first housing 4 has the engagement claw 310, the second housing 5 has at least the engagement hole 320 to be engaged with the engagement claw 310 of the first housing 4. When the first housing 4 has the engagement hole 320, the second housing 5 has at least the engagement claw 310 to be engaged with the engagement hole 320 of the first housing 4.

The engagement claw 310 is attached to the engagement hole 320 by a snap-fit method. That is, the engagement claw 310 and the engagement hole 320 are engaged with each other by using each elastic deformation of the first housing 4 and the second housing 5. Accordingly, the first housing 4 can be easily fixed to the second housing 5.

In the work of attaching the second housing 5 to the first housing 4, it is only necessary to fit the first housing 4 into the second housing 5 from above. That is, it is not necessary to provide a jig for fixing the first housing 4 and the second housing 5 so that the first housing 4 and the second housing 5 are not displaced at the time of attachment work. This facilitates attachment work.

In the example embodiment, the first housing 4 has two engagement claws 310 and two engagement holes 320. The second housing 5 has two engagement claws 310 and two engagement holes 320. The engagement claws 310 and the engagement holes 320 are located on a diagonal of the housing 3 when viewed from the axial direction. Hereinafter, a first diagonal of the housing 3 will be denoted by reference numeral L1, and a second diagonal of the housing 3 will be denoted by reference numeral L2 (see FIG. 3).

The engagement claw 310 of the first housing 4 is located at each of a pair of corners 30 located on the first diagonal L1. The engagement hole 320 of the first housing 4 is located at each of a pair of corners 30 located on the second diagonal L2. The engagement hole 320 of the second housing 5 is located at each of a pair of corners 30 located on the first diagonal L1. The engagement claw 310 of the second housing 5 is located at each of a pair of corners 30 located on the second diagonal L2.

In this configuration, the first housing 4 and the second housing 5 are fixed at four locations, so that the first housing 4 and the second housing 5 can be more firmly fixed.

The engagement claw 310 protrudes to the radially outer side from the outer surface of the cylindrical portion 300. On the other hand, the engagement hole 320 is formed in a tongue portion 321 (see FIGS. 3 and 4) extending in the axial direction from the axial end surface of the cylindrical portion 300. In this configuration, at the time of attaching the first housing 4 to the second housing 5, it is necessary to insert the counterpart cylindrical portion 300 between the pair of tongue portions 321 opposing each other in the radial direction.

Therefore, for example, in a configuration in which the engagement claws 310 are provided at all of the four corners 30 of the first housing 4 (alternatively, the second housing 5) and the engagement holes 320 are provided at all of the four corners 30 of the second housing 5 (alternatively, the first housing 4), when the first housing 4 is inclined with respect to the second housing 5 at the time of attaching the first housing 4 to the second housing 5, it is difficult to attach the first housing 4 to the second housing 5.

On the other hand, in the configuration of the example embodiment, the tongue portion 321 exists at the pair of corners 30 located on the second diagonal L2 of the first housing 4, but the tongue portion 321 does not exist at the pair of corners 30 located on the first diagonal L1. In other words, in the second housing 5, the tongue portion 321 exists at the pair of corners 30 located on the first diagonal L1, but the tongue portion 321 does not exist at the pair of corners 30 located on the second diagonal L2. As a result, the counterpart cylindrical portion 300 can be easily inserted between the pair of tongue portions 321 opposing each other in the radial direction. As a result, attachment work of the first housing 4 to the second housing 5 is facilitated.

Figure 11:
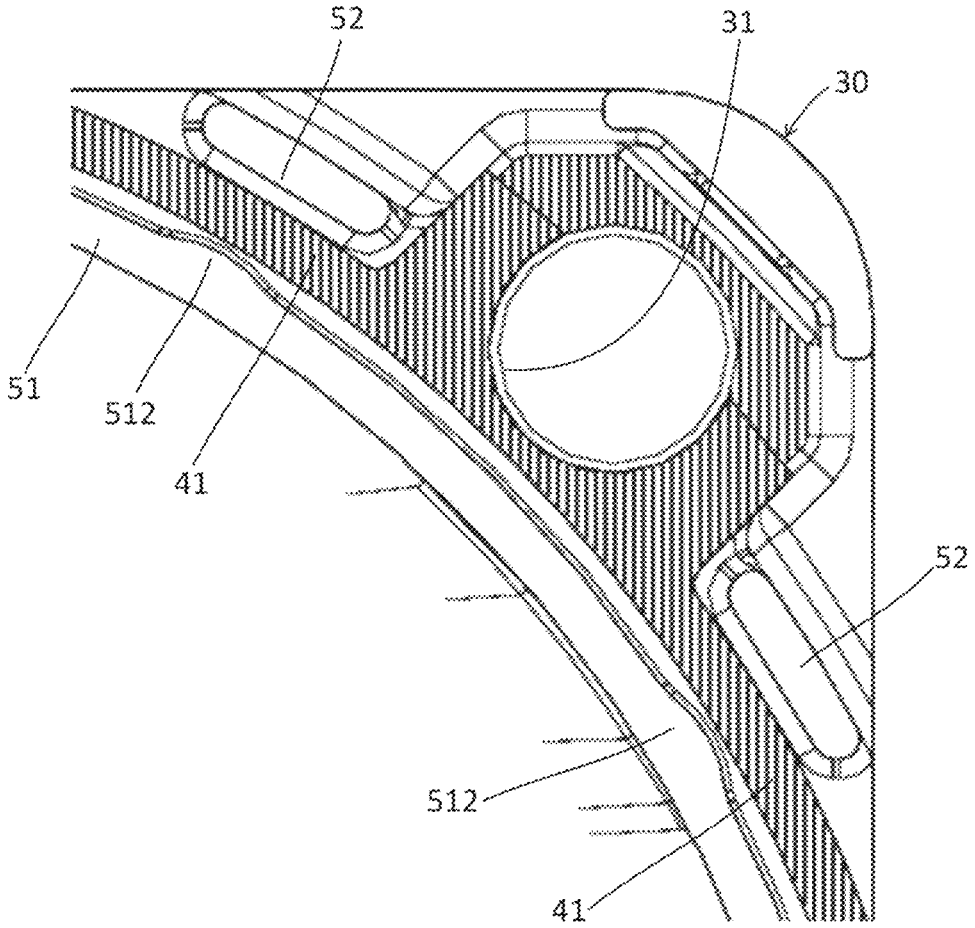
FIG. 11 is an enlarged cross-sectional view of a first wall portion, a second wall portion, and the periphery thereof according to the first modification.

FIG. 11 is an enlarged cross-sectional view of the first wall portion 41 and the second wall portion 51 according to a modification and surroundings thereof. FIG. 11 is a cross-sectional view of the first housing 4 fixed to the second housing 5 taken along a plane parallel to the radial direction.

The second wall portion 51 has a protrusion 512 on the radially outer surface. The protrusion 512 protrudes to the radially outer side. The protrusion 512 is in contact with the radially inner surface of the first wall portion 41. For example, the protrusion 512 may extend linearly in the axial direction. The protrusion 512 may have a dot shape. In the modification, by accurately forming the protruding amount of the protrusion 512 to the radially outer side, the deviation of the first housing in the radial direction can be suppressed even if the radially outer surface of the second wall portion 51 is not accurately finished over the entire surface.

A second example embodiment will be described below with reference to the drawings.

The outer shape of the housing 3 is a quadrangular shape having four corners 30 when viewed from the axial direction. Each corner 30 may be rounded. For example, each corner 30 has an R-chamfered shape. However, each corner 30 may have a right angle shape. Each corner 30 may have a C-chamfered shape.

Here, the housing 3 includes a first housing 4 and a second housing 5. The first housing 4 is located on one side in the axial direction. The second housing 5 is located on the other side in the axial direction. That is, the first housing 4 is located on the upper side. The second housing 5 is located on the lower side. The first housing 4 and the second housing 5 are joined to each other in the axial direction.

The housing 3 has a cylindrical portion 300 centered on the center axis CA. That is, each of the first housing 4 and the second housing 5 has the cylindrical portion 300 centered on the center axis CA. The cylindrical portions 300 of the first housing 4 and the second housing 5 are joined to each other in the axial direction. In the following description, when it is necessary to distinguish the cylindrical portions 300 of the first housing 4 and the second housing 5, the cylindrical portion 300 of the first housing 4 is denoted by reference numeral 400 and is referred to as a first cylindrical portion 400, and the cylindrical portion 300 of the second housing 5 is denoted by reference numeral 500 and is referred to as a second cylindrical portion 500.

The cylindrical portion 300 covers the rotor 1 and the stator 2 from the radially outer side. The rotor blade 210 are attached to the rotor 1. Therefore, the rotor blade 210 is covered by the cylindrical portion 300 from the radially outer side. The cylindrical portion 300 guides the airflow generated by the rotation of the rotor blade 210 in the axial direction.

The second housing 5 holds the shaft holder 110. In other words, the second housing 5 holds the stator 2. Specifically, the second housing 5 has a base portion 510 that holds the stator 2. For example, the base portion 510 is the same member as the second housing 5, and is formed integrally with the second housing 5.

The base portion 510 has a disk shape centered on the center axis CA. The shaft holder 110 is fixed to the radial center of the base portion 510. The base portion 510 has a plurality of connection portions 510*a* extending to the radially outer side from the radially outer surface. The connection portion 510*a* is connected to the radially inner surface of the second cylindrical portion 500. In other words, the connection portion 510*a* connects the base portion 510 and the second cylindrical portion 500.

The cylindrical portion 300 has a wiring portion 301 in which the lead wire 20 is located. Specifically, the first housing 4 has a wiring convex portion 401 in the first cylindrical portion 400, and the second housing 5 has a wiring recess 501 in the second cylindrical portion 500.

The wiring convex portion 401 extends downward from the lower end surface of the first cylindrical portion 400. On the other hand, the wiring recess 501 is recessed downward from the upper end surface of the second cylindrical portion 500 and penetrates the second cylindrical portion 500 in the radial direction. The wiring convex portion 401 is located in the wiring recess 501.

The wiring portion 301 includes the wiring convex portion 401 and the wiring recess 501 (see FIG. 6). Specifically, the wiring portion 301 is constituted by a gap between the tip portion of the wiring convex portion 401 and the bottom portion of the wiring recess 501 in the axial direction. The lead wire 20 is located in a gap between the tip portion of the wiring convex portion 401 and the bottom of the wiring recess 501 in the axial direction. In other words, the through-hole for wiring is formed by the gap between the tip portion of the wiring convex portion 401 and the bottom of the wiring recess 501 in the axial direction. The lead wire 20 is drawn out to the radially outer side from the radially inner side of the housing 3 through the through-hole.

Figure 12:
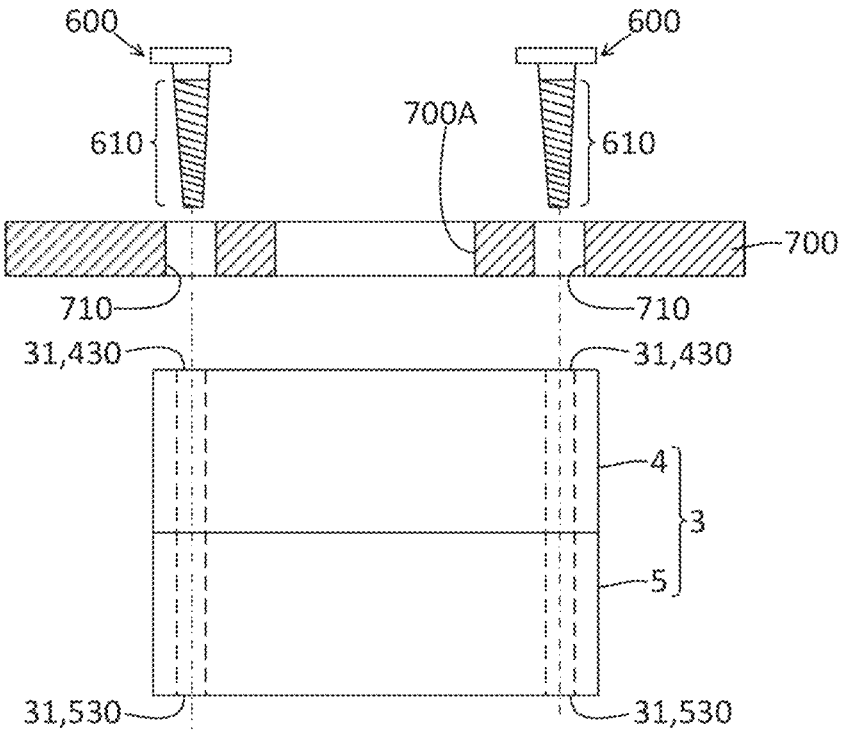
FIG. 12 is a schematic view illustrating a fixing structure by a fastening member of the housing according to the second example embodiment.

Here, the housing 3 has a through-hole 31 penetrating in the axial direction. For example, one through-hole 31 is provided at each of the four corners 30. The through-hole 31 is located on a diagonal of the housing 3. A fastening member 600 (see FIG. 12) is located in the through-hole 31.

The fastening member 600 has a screw portion 610. For example, the fastening member 600 is a tapping screw. The tapping screw as the fastening member 600 is screwed into a small-diameter portion 311 (see FIG. 13) of the through-hole 31. That is, the small-diameter portion 311 of the through-hole 31 is a hole into which the fastening member 600 having the screw portion 610 is screwed.

For example, a fixing member 700 has an air outlet 700A. The fixing member 700 has four attachment holes 710 arranged in the same pattern as the arrangement pattern of the four through-holes 31. The attachment hole 710 is a hole that penetrates the fixing member 700 in the axial direction, and is a hole whose hole diameter (inner diameter) is larger than the outer diameter (nominal diameter) of the external thread of the tapping screw serving as the fastening member 600.

The fixing member 700 is in contact with the upper end surface of the housing 3. That is, the fixing member 700 is in contact with the upper end surface of the first housing 4.

The fastening member 600 is inserted into the attachment hole 710 from above the fixing member 700 and screwed into the through-hole 31. By screwing the fastening member 600 into the through-hole 31, the through-hole 31 is threaded, and the fastening member 600 is fixed to the through-hole 31. As a result, the housing 3 is fixed to the fixing member 700.

Although not illustrated, the fixing member 700 may be brought into contact with the lower end surface of the housing 3. That is, the fixing member 700 may be brought into contact with the lower end surface of the second housing 5. Then, the fastening member 600 may be screwed into the through-hole 31 from below the housing 3.

Figure 13:
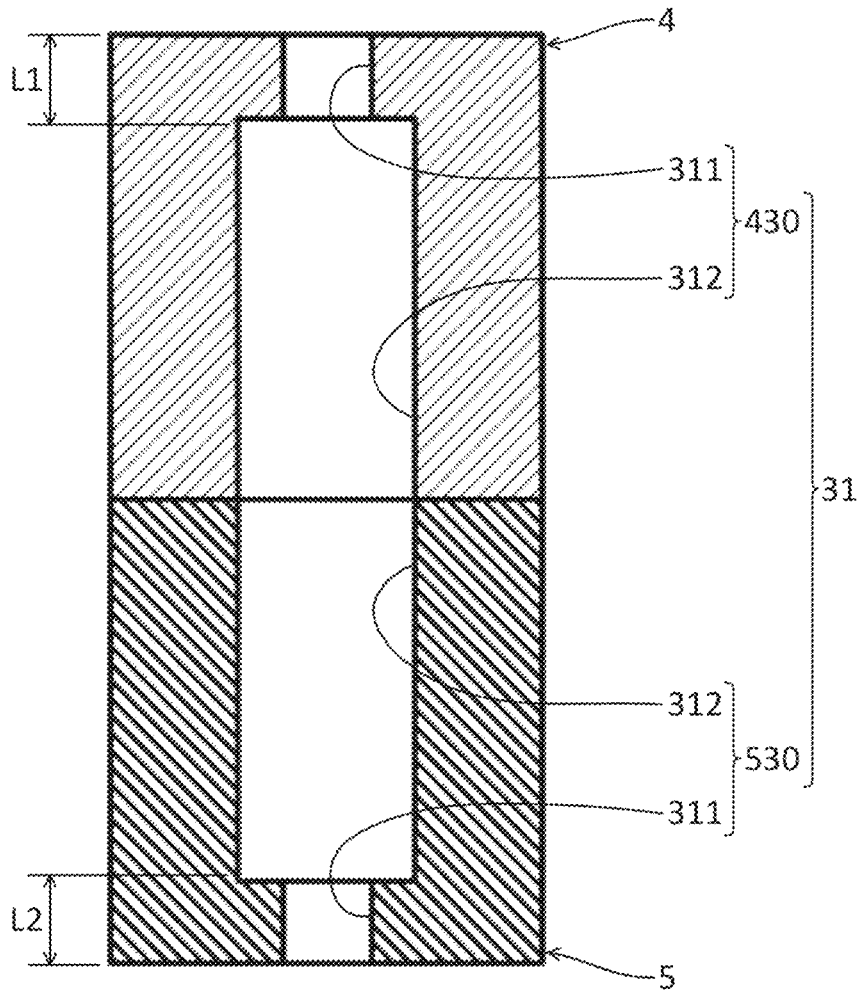
FIG. 13 is a cross-sectional view schematically illustrating a cross-sectional structure of a through-hole according to the second example embodiment.

FIG. 13 is a cross-sectional view schematically illustrating a cross-sectional structure of the through-hole 31 according to the example embodiment. FIG. 13 is a cross-sectional view of the housing 3 taken along a plane parallel to the axial direction.

The through-hole 31 includes a first through-hole 430 and a second through-hole 530. The first through-hole 430 is located in the first housing 4. The second through-hole 530 is located in the second housing 5. In other words, the through-hole 31 is a hole obtained by connecting the first through-hole 430 and the second through-hole 530 in the axial direction. In other words, the first through-hole 430 and the second through-hole 530 overlap each other when viewed from the axial direction.

Here, at least one of the first through-hole 430 and the second through-hole 530 includes a small-diameter portion 311 and a large-diameter portion 312 having a larger hole diameter than the small-diameter portion 311. In this configuration, when the fastening member 600 is screwed into the through-hole 31, it is possible to suppress the contact of the fastening member 600 with the inner peripheral surface of the large-diameter portion 312. That is, the fastening member 600 is fixed to the through-hole 31 by screwing the inner peripheral surface of the small-diameter portion 311. As a result, the stress generated around the large-diameter portion 312 of the housing 3 can be alleviated. As a result, deformation of the housing 3 can be suppressed.

The hole diameter of the large-diameter portion 312 is larger than the outer diameter of the screw portion 610 of the fastening member 600. For example, the hole diameter of the large-diameter portion 312 is larger than the outer diameter of the screw portion 610 of the fastening member 600 by 5% to 20%. Accordingly, it is possible to suppress the contact of the fastening member 600 with the inner peripheral surface of the large-diameter portion 312.

Further, the axial length of the small-diameter portion 311 is shorter than the axial length of the large-diameter portion 312. For example, the axial length of the small-diameter portion 311 is shorter than the axial length of the screw portion 610 of the fastening member 600. As a result, a region of the through-hole 31 where the screw is cut by the fastening member 600, that is, a region of the through-hole 31 which is in contact with the fastening member 600 is reduced. Therefore, the stress generated by screwing the fastening member 600 into the through-hole 31 can be reliably alleviated.

In the example embodiment, the small-diameter portion 311 and the large-diameter portion 312 are provided in the first through-hole 430. The small-diameter portion 311 of the first through-hole 430 is located on one side in the axial direction, and the large-diameter portion 312 of the first through-hole 430 is located on the other side in the axial direction. In other words, the small-diameter portion 311 of the first through-hole 430 is located on the upper end surface side of the first housing 4. In other words, the first housing 4 has an opening formed by the small-diameter portion 311 of the first through-hole 430 on the upper end surface.

In the first through-hole 430, a portion up to a first distance L1 downward from the upper end surface of the first housing 4 is the small-diameter portion 311, and the entire portion below the small-diameter portion 311 is the large-diameter portion 312. The small-diameter portion 311 of the first through-hole 430 has a shorter axial length than the large-diameter portion 312 of the first through-hole 430.

For example, when the fixing member 700 is located above the housing 3, the fastening member 600 is screwed downward from the upper end surface side of the first housing 4. That is, the fastening member 600 is screwed downward from the upper portion of the first through-hole 430. In this case, by providing the small-diameter portion 311 and the large-diameter portion 312 in the first through-hole 430, the stress generated around the first through-hole 430 in the first housing 4 can be alleviated. Accordingly, deformation of the first housing 4 can be suppressed.

In the first through-hole 430, the small-diameter portion 311 is thicker than the large-diameter portion 312. That is, by disposing the small-diameter portion 311 on the upper end surface side of the first housing 4, the strength on the upper end surface side of the first housing 4 can be secured. Accordingly, even when the fixing member 700 comes into contact with the upper end surface of the first housing 4 with a large pressure, it is possible to suppress deformation of the first housing 4.

In the example embodiment, the small-diameter portion 311 and the large-diameter portion 312 are further provided in the second through-hole 530. The small-diameter portion 311 of the second through-hole 530 is located on the other side in the axial direction, and the large-diameter portion 312 of the second through-hole 530 is located on one side in the axial direction. In other words, the small-diameter portion 311 of the second through-hole 530 is located on the lower end surface side of the second housing 5. In other words, the second housing 5 has an opening formed by the small-diameter portion 311 of the second through-hole 530 on the lower end surface.

In the second through-hole 530, a portion from the lower end surface of the second housing 5 upward to a second distance L2 is the small-diameter portion 311, and the entire portion above the small-diameter portion 311 is the large-diameter portion 312. The small-diameter portion 311 of the second through-hole 530 is shorter in axial length than the large-diameter portion 312 of the second through-hole 530. The first distance L1 and the second distance L2 may be the same.

For example, when the fixing member 700 is located below the housing 3, the fastening member 600 is screwed upward from the lower end surface side of the second housing 5. That is, the fastening member 600 is screwed upward from the lower portion of the second through-hole 530. In this case, by providing the small-diameter portion 311 and the large-diameter portion 312 in the second through-hole 530, the stress generated around the second through-hole 530 in the second housing 5 can be alleviated. Accordingly, deformation of the second housing 5 can be suppressed.

In the second through-hole 530, the small-diameter portion 311 is thicker than the large-diameter portion 312. That is, by disposing the small-diameter portion 311 on the lower end surface side of the second housing 5, the strength on the lower end surface side of the second housing 5 can be secured. Accordingly, even when the fixing member 700 comes into contact with the lower end surface of the second housing 5 with a large pressure, it is possible to suppress deformation of the second housing 5.

In the example embodiment, both the first through-hole 430 and the second through-hole 530 have the small-diameter portion 311 and the large-diameter portion 312, respectively. As a result, deformation of the housing 3 can be suppressed without changing the design of the housing 3 in both the case where the fixing member 700 is located above the housing 3 and the case where the fixing member 700 is located below the housing 3.

Figure 14:
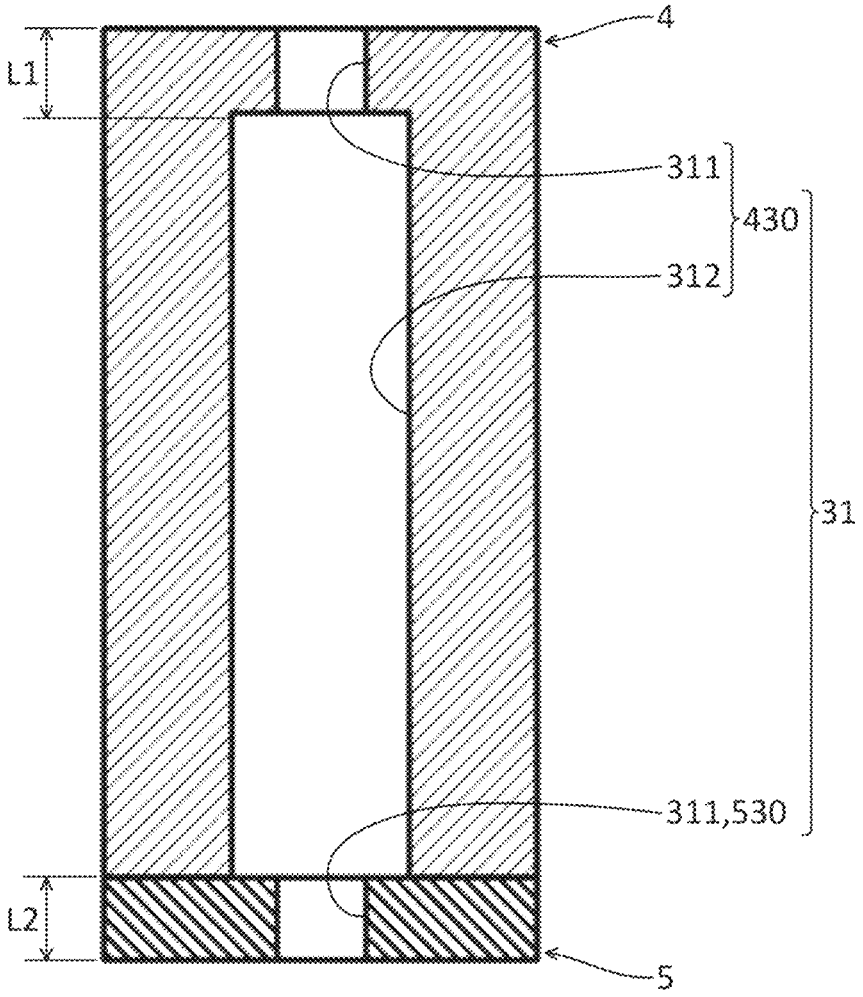
FIG. 14 is a cross-sectional view schematically illustrating a cross-sectional structure of a through-hole according to a second modification of an example embodiment of the present disclosure.

FIG. 14 is a cross-sectional view schematically illustrating a cross-sectional structure of a through-hole 31 according to a modification. FIG. 14 is a cross-sectional view of the housing 3 taken along a plane parallel to the axial direction.

In the modification, only one of the first through-hole 430 and the second through-hole 530 has the small-diameter portion 311 and the large-diameter portion 312. For example, the first through-hole 430 has a small-diameter portion 311 and a large-diameter portion 312. On the other hand, the second through-hole 530 has only the small-diameter portion 311.

In the modification, the axial length of the first through-hole 430 is longer than that of the above example embodiment. For example, in the modification, the axial length of the small-diameter portion 311 of each of the first through-hole 430 and the second through-hole 530 is the same as that in the above example embodiment, and the axial length of the large-diameter portion 312 of the first through-hole 430 is longer than that in the above example embodiment. The large-diameter portion 312 of the first through-hole 430 is connected to the small-diameter portion 311 of the second through-hole 530.

In the modification, when the through-hole 31 is viewed as a whole, the small-diameter portion 311 is located on each of the upper end surface side of the first housing 4 and the lower end surface side of the second housing 5 as in the above example embodiment, and the large-diameter portion 312 is located between the two small-diameter portions 311 in the axial direction. Therefore, regardless of whether the fixing member 700 is located above the housing 3 or the fixing member 700 is located below the housing 3, the stress generated in the housing 3 can be alleviated when the housing 3 is fixed to the fixing member 700 using the fastening member 600. Accordingly, deformation of the housing 3 can be suppressed.

FIG. 8 is an enlarged cross-sectional view of a corner 30 of the housing 3 according to the example embodiment. FIG. 8 is a cross-sectional view of the first housing 4 fixed to the second housing 5 taken along a plane parallel to the radial direction.

One of the first housing 4 and the second housing 5 has a convex portion 414 protruding to the radially inner side from the radially inner surface. The other one of the first housing 4 and the second housing 5 has a recess 511 that is recessed in the axial direction and in which the convex portion 414 is located. The convex portion 414 is provided at the outer edge portion of the through-hole 31. That is, the convex portion 414 is provided on the radially inner side of one outer edge portion of the first through-hole 430 and the second through-hole 530. The recess 511 is provided on the radially inner side of the other outer edge portion of the first through-hole 430 and the second through-hole 530.

In this configuration, the strength of one outer edge portion provided with the convex portion 414 of the first through-hole 430 and the second through-hole 530 can be increased. By providing the recess 511 in the other outer edge portion of the first through-hole 430 and the second through-hole 530, even if the convex portion 414 is provided in one outer edge portion, the convex portion 414 can be arranged in the recess 511.

The convex portion 414 is provided in the first housing 4. That is, the convex portion 414 is provided on the radially inner side of the outer edge portion of the first through-hole 430. Accordingly, the strength of the outer edge portion of the first through-hole 430 can be increased. For example, when the fastening member 600 is screwed into the first through-hole 430, it is possible to suppress deformation of the outer edge portion of the first through-hole 430. That is, deformation of the first housing 4 can be suppressed.

Here, since the second housing 5 has the base portion 510, the strength is relatively high. On the other hand, the first housing 4 does not have a portion corresponding to the base portion 510. Therefore, it is preferable to increase the strength by disposing the convex portion 414 on the outer edge portion of the first through-hole 430.

In the configuration in which the convex portion 414 is provided in the first housing 4, the recess 511 is provided in the second housing 5. That is, the recess 511 is provided on the radially inner side of the second through-hole 530. In this case, the recess 511 is recessed downward.

A second aspect of the present disclosure has the following configuration.

(1)
A motor including:
a rotor rotatable about a center axis extending vertically;
a stator rotating the rotor; and
a housing covering the rotor and the stator from a radially outer side, in which
the housing includes:
a first housing located on one side in an axial direction; and
a second housing located on another side in the axial direction,
the housing has a through-hole penetrating in the axial direction,
the through-hole includes:
a first through-hole located in the first housing; and
a second through-hole located in the second housing, and
at least one of the first through-hole and the second through-hole includes:
a small-diameter portion; and
a large-diameter portion having a larger hole diameter than the small-diameter portion.

(2)
The motor according to (1), in which
the small-diameter portion and the large-diameter portion are provided in the first through-hole,
the small-diameter portion of the first through-hole is located on one side in the axial direction, and
the large-diameter portion of the first through-hole is located on another side in the axial direction.

(3)
The motor according to (1) or (2), in which
the small-diameter portion and the large-diameter portion are provided in the second through-hole,
the small-diameter portion of the second through-hole is located on another side in the axial direction, and
the large-diameter portion of the second through-hole is located on one side in the axial direction.

(4)

The motor according to any one of (1) to (3), in which one of the first housing and the second housing has a convex portion protruding to the radially inner side from a radially inner surface, another one of the first housing and the second housing has a recess that is recessed in the axial direction and in which the convex portion is located, and the convex portion is provided at an outer edge portion of the through-hole.

(5)

The motor according to any one of (1) to (4), in which the small-diameter portion of the through-hole is a hole into which a fastening member having a screw portion is screwed, and a hole diameter of the large-diameter portion is larger than an outer diameter of the screw portion.

(6)

The motor according to any one of (1) to (5), in which a length of the small-diameter portion in the axial direction is shorter than a length of the large-diameter portion in the axial direction.

(7)

An axial fan including:

the motor according to any one of (1) to (6); and a rotor blade attached to the rotor.

A third exemplary example embodiment will be described below with reference to the drawings.

Figure 16:
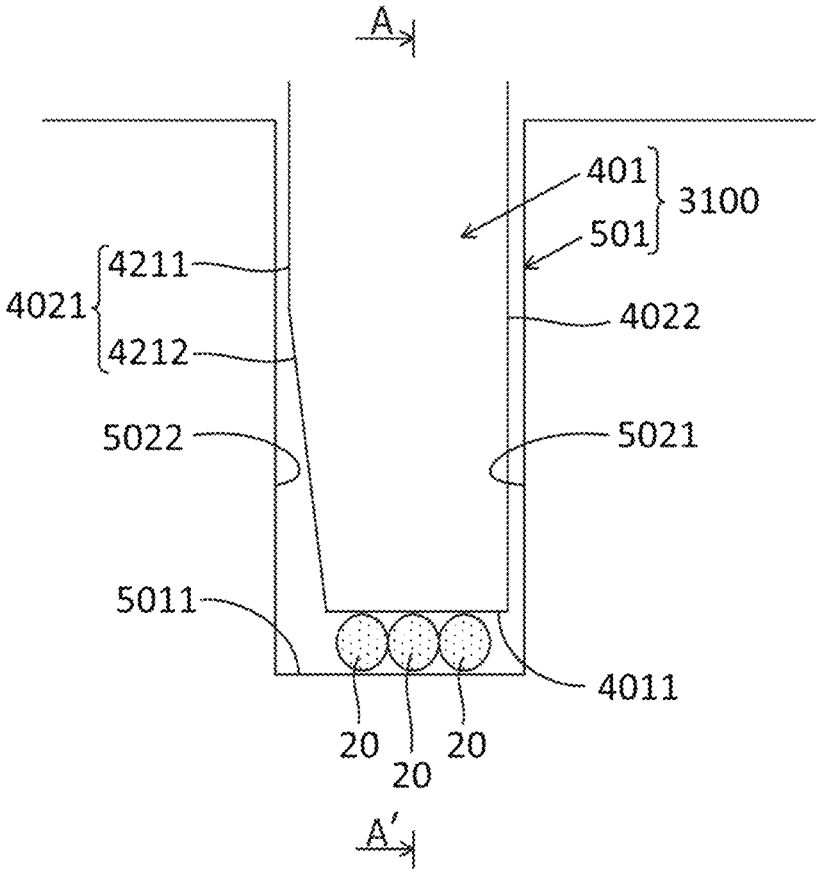
FIG. 16 is a schematic view of a lead wire passing portion according to the third example embodiment.
Figure 17:
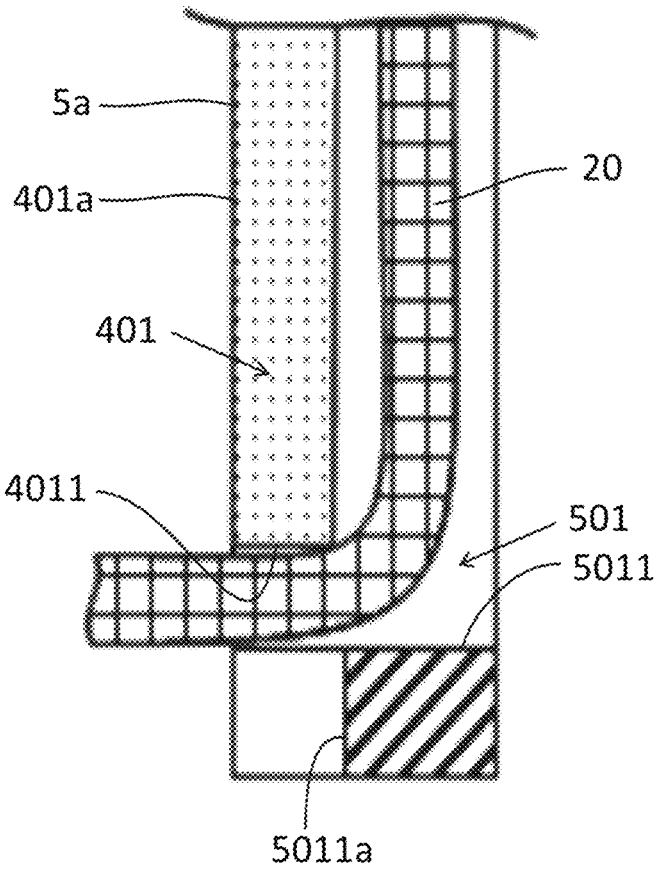
FIG. 17 is a schematic view illustrating a positional relationship between a radially inner surface and a convex portion of the second housing according to the third example embodiment.
Figure 18:
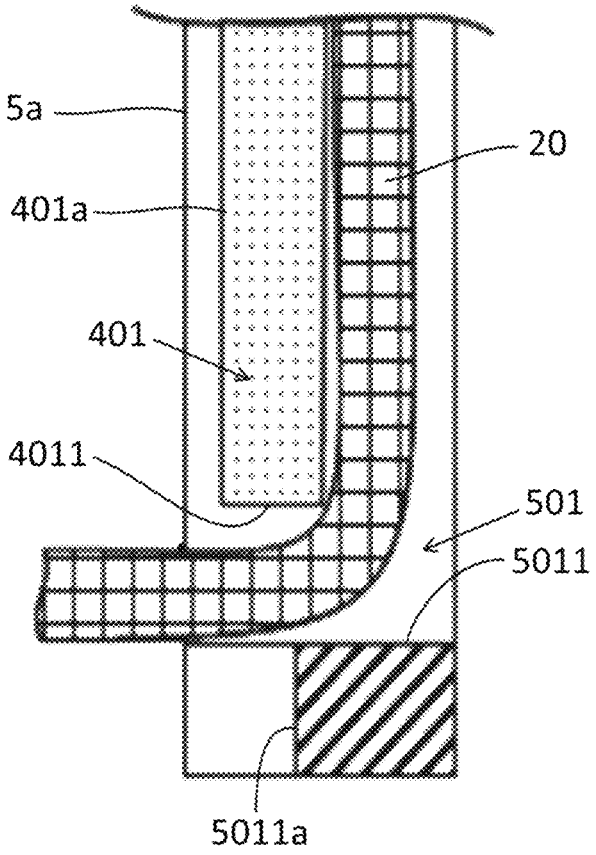
FIG. 18 is a schematic view illustrating a positional relationship between a radially inner surface and a convex portion of the second housing according to a third modification of an example embodiment of the present disclosure.
Figure 19:
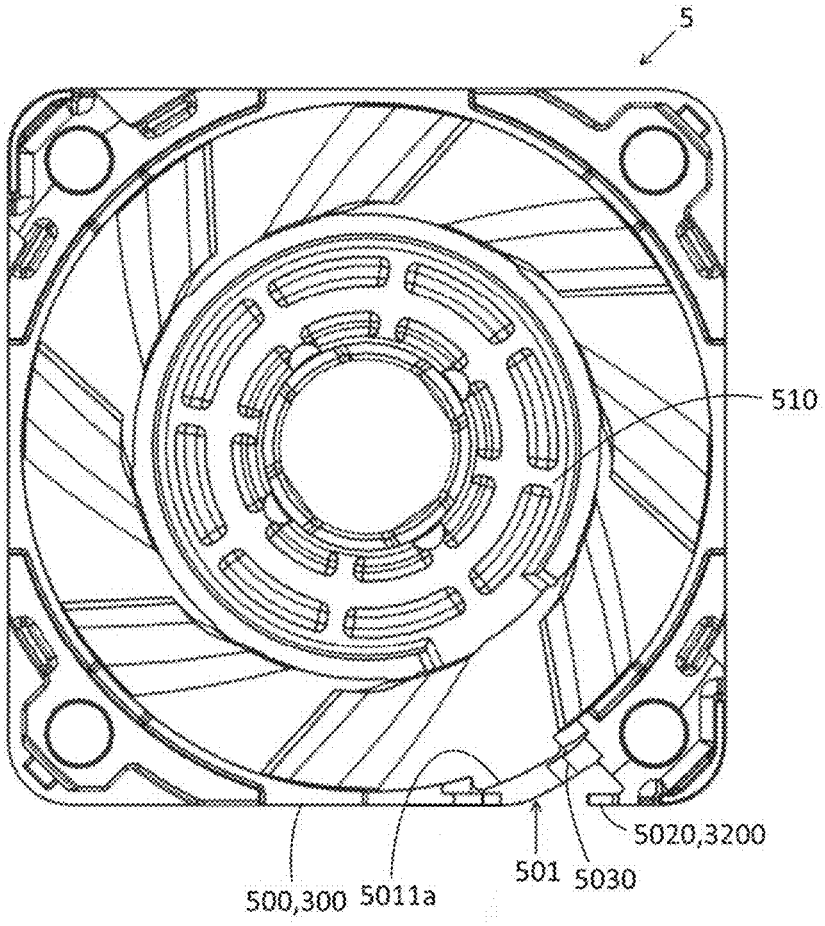
FIG. 19 is a plan view of the second housing according to the third example embodiment as viewed from the axial direction.
Figure 20:
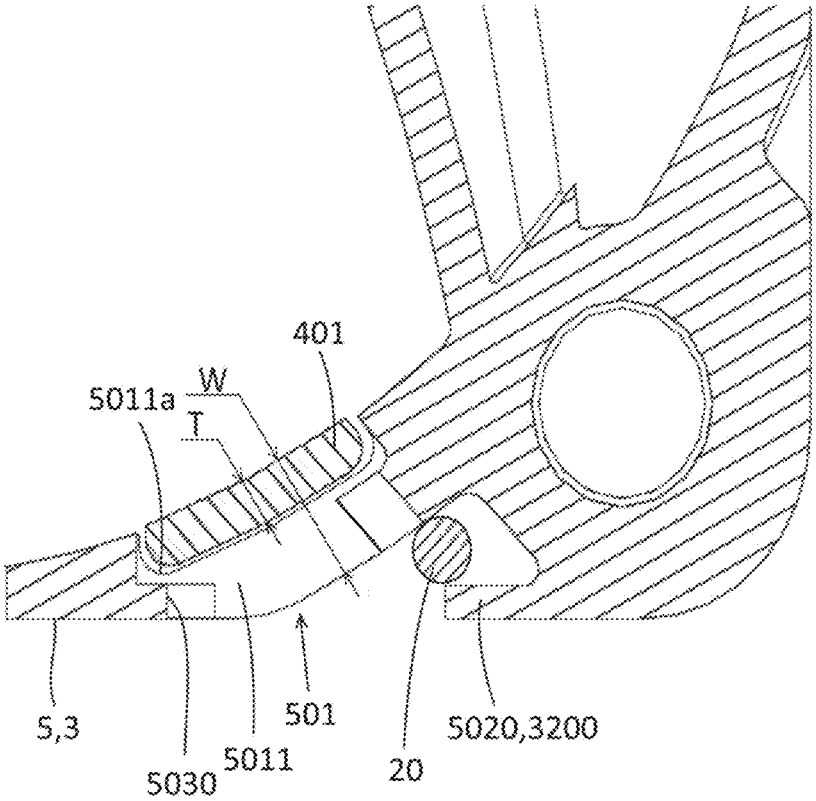
FIG. 20 is an enlarged cross-sectional view of a wiring convex portion, a wiring recess, and the periphery thereof cut along a plane orthogonal to the axial direction according to the third example embodiment.

FIG. 16 is a schematic view of a lead wire passing portion 3100 according to the example embodiment. FIG. 17 is a schematic view illustrating a positional relationship between a radially inner surface 5*a* of the second housing 5 and the wiring convex portion 401 according to the example embodiment. FIG. 18 is a schematic view illustrating a positional relationship between the radially inner surface 5*a* of the second housing 5 and the wiring convex portion 401 according to the modification. FIGS. 17 and 18 are cross-sectional views taken along line A-A' of FIG. 16. In FIGS. 17 and 18, the left side of the drawing is the radially inner side, and the right side of the drawing is the radially outer side. FIG. 19 is a plan view of the second housing 5 according to the example embodiment as viewed from the axial direction. FIG. 20 is an enlarged cross-sectional view of the wiring convex portion 401, the wiring recess 501, and the periphery thereof according to the example embodiment taken along a plane orthogonal to the axial direction.

The housing 3 has the lead wire passing portion 3100. The lead wire passing portion 3100 is a through-hole penetrating the housing 3 in the radial direction. The lead wire 20 passes through the through-hole of the lead wire passing portion 3100. In other words, the lead wire 20 is located in the lead wire passing portion 3100. The lead wire 20 is drawn out to the radially outer side from the radially inner side of the housing 3 via the lead wire passing portion 3100. The lead wire passing portion 3100 includes the first housing 4 and the second housing 5.

Specifically, the first housing 4 has the wiring convex portion 401 protruding toward the other side in the axial direction. The wiring convex portion 401 is a portion protruding downward from the lower end surface of the first cylindrical portion 400. The wiring convex portion 401 has a tip surface 4011 opposing the other side in the axial direction. The tip surface 4011 is a lower end surface of the wiring convex portion 401.

The second housing 5 has a wiring recess 501 that is recessed toward the other side in the axial direction and penetrates in the radial direction. Specifically, the wiring recess 501 is recessed from the end surface on one side in the axial direction of the second cylindrical portion 500 toward the other side in the axial direction. That is, the wiring recess 501 is a portion recessed downward from the upper end surface of the second cylindrical portion 500. The wiring recess 501 has a bottom surface 5011 opposing one side in the axial direction. The wiring convex portion 401 is located in the wiring recess 501.

The lead wire passing portion 3100 includes the wiring convex portion 401 and the wiring recess 501. In other words, the through-hole of the lead wire passing portion 3100 is formed by a gap generated between the tip surface 4011 and the bottom surface 5011 in the axial direction when viewed from the radial direction. The lead wire 20 is located between the tip surface 4011 and the bottom surface 5011 when viewed from the radial direction. The lead wire 20 is drawn out to the radially outer side from the radially inner side of the housing 3 through a gap between the tip surface 4011 and the bottom surface 5011 in the axial direction.

Here, the wiring convex portion 401 is located in the wiring recess 501. However, at least a part of the tip surface 4011 does not face the bottom surface 5011 in the axial direction. That is, at least a part of the tip surface 4011 is located at a position shifted in the radial direction from a position axially opposing the bottom surface 5011. In this configuration, the restraint in the axial direction is weak for at least a part of the lead wire 20 located in the lead wire passing portion 3100.

As a result, it is possible to suppress an excessive load from being applied to the lead wire 20 drawn out to the radially outer side from the radially inner side of the housing 3. As a result, the lead wire 20 can be easily drawn out from the housing 3 and run along the radially outer surface of the housing 3. That is, the lead wire 20 drawn out from the housing 3 can be easily fixed to the radially outer surface of the housing 3.

The wiring recess 501 has a notch 5011*a* on the bottom surface 5011. The notch 5011*a* of the wiring recess 501 penetrates in the axial direction and is recessed to the radially outer side from the radially inner surface of the second housing 5. Specifically, the notch 5011*a* of the wiring recess 501 is recessed to the radially outer side from the radially inner surface of the second cylindrical portion 500. That is, the wiring recess 501 has a region where the bottom surface 5011 exists and a region where the bottom surface 5011 is missing when viewed from the axial direction. A region of the wiring recess 501 where the bottom surface 5011 is missing is the notch 5011*a*.

At least a part of the tip surface 4011 is located at a position opposing the notch 5011*a* of the wiring recess 501 in the axial direction. That is, at least a part of the tip surface 4011 does not face the bottom surface 5011. As a result, at least a part of the tip surface 4011 can be easily located at a position shifted in the radial direction from the position axially opposing the bottom surface 5011.

For example, the entire portion of the tip surface 4011 is located at a position opposing the notch 5011*a* of the wiring recess 501 in the axial direction. That is, the tip surface 4011 does not face the bottom surface 5011 in the axial direction over the entire surface. In this configuration, it is possible to further suppress an excessive load from being applied to the lead wire 20 drawn out from the housing 3.

A part of the tip surface 4011 may be located to face the bottom surface 5011 in the axial direction. That is, a part of the tip surface 4011 may face the bottom surface 5011 in the axial direction, and the other portion may face the notch 5011*a* of the wiring recess 501 in the axial direction.

In the configuration of the example embodiment illustrated in FIG. 17, the surface 401*a* of the wiring convex portion 401 opposing the radially inner side is flush with the radially inner surface 5*a* of the second housing 5. As a result, since no step is generated on the radially inner surface of the housing 3, it is possible to suppress the airflow from becoming unstable on the radially inner side of the housing 3. As a result, the blowing efficiency of the axial fan 200 is improved. It is possible to prevent the wiring convex portion 401 from coming into contact with the rotor blade 210.

The configuration illustrated in FIG. 18 can be adopted as a modification. In the modification, the surface 401*a* of the wiring convex portion 401 opposing the radially inner side is located on the radially outer side from the radially inner surface 5*a* of the second housing 5. In other words, the surface 401*a* of the wiring convex portion 401 opposing the radially inner side may not be flush with the radially inner surface 5*a* of the second housing 5. In other words, the surface 401*a* of the wiring convex portion 401 opposing the radially inner side may not protrude to the radially inner side from the radially inner surface 5*a* of the second housing 5.

In the modification, a step is generated on the radially inner surface of the housing 3. However, since the wiring convex portion 401 does not protrude to the radially inner side with respect to the radially inner surface 5*a* of the second housing 5, it is possible to prevent the wiring convex portion 401 from contacting the rotor blade 210.

In a case where the tip surface 4011 is displaced in the radial direction with respect to the bottom surface 5011 by causing the notch 5011*a* of the wiring recess 501 and the tip surface 4011 to oppose each other in the axial direction, it is necessary to increase the width of the notch 5011*a* of the wiring recess 501 in the radial direction as the thickness of the wiring convex portion 401 in the radial direction increases. In other words, the larger the thickness of the wiring convex portion 401 in the radial direction, the smaller the width of the bottom surface 5011 in the radial direction needs to be. However, if the width of the bottom surface 5011 in the radial direction is small, the strength of the peripheral portion of the wiring recess 501 of the second housing 5 decreases.

Therefore, the thickness T of the wiring convex portion 401 in the radial direction is less than or equal to half of the opening width W in the radial direction when viewed from the axial direction of the wiring recess 501 (see FIG. 20). As a result, it is possible to suppress the radial width of the bottom surface 5011 from becoming too small. As a result, it is possible to suppress a decrease in strength of the peripheral portion of the wiring recess 501 in the second housing 5.

Figure 15:
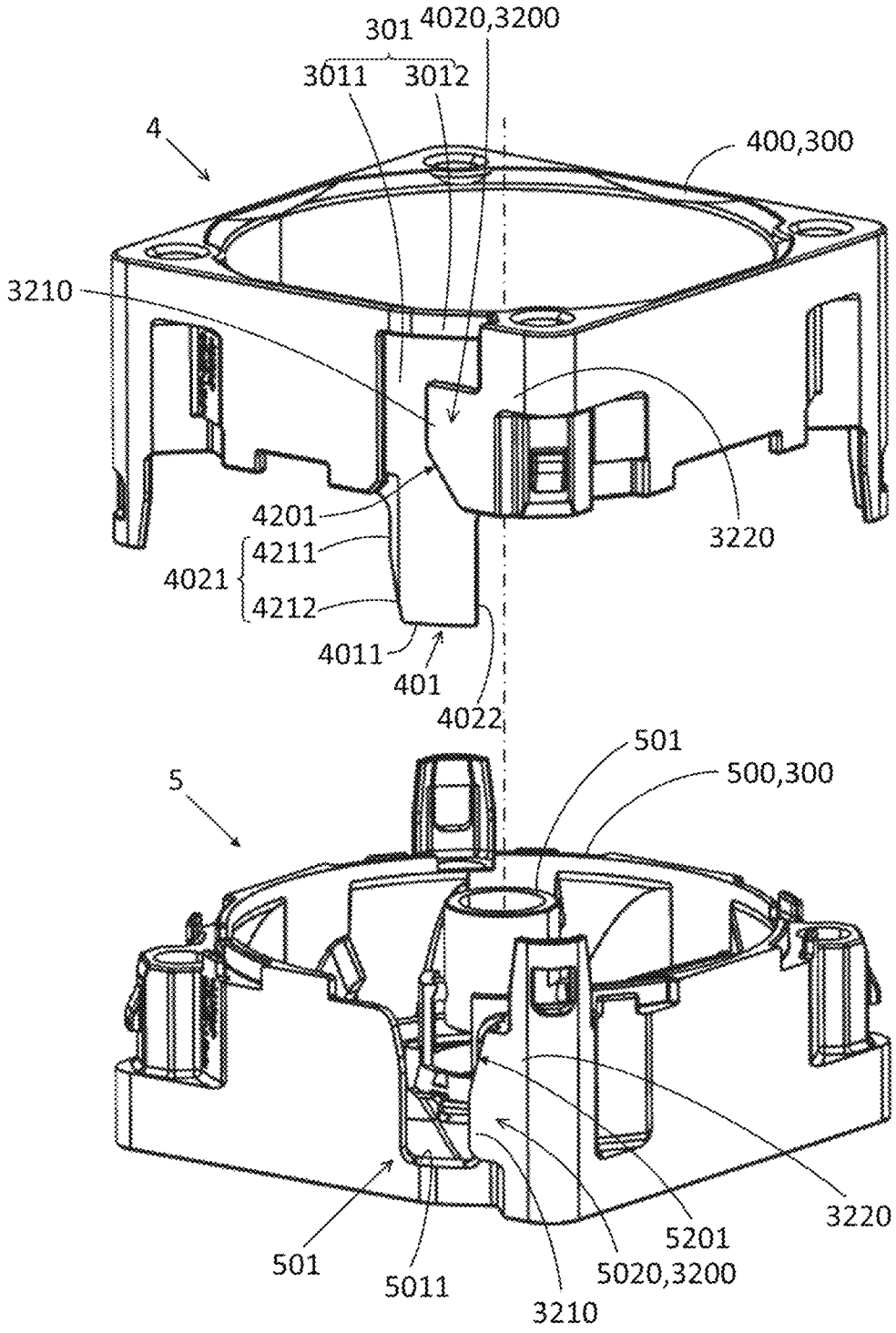
FIG. 15 is an exploded perspective view of the housing according to the third example embodiment.

As illustrated in FIGS. 15 and 16, the wiring convex portion 401 has a first outer surface 4021 opposing one side in the circumferential direction and a second outer surface 4022 opposing the other side in the circumferential direction. The wiring recess 501 has a first inner surface 5021 opposing one side in the circumferential direction and a second inner surface 5022 opposing the other side in the circumferential direction. The first outer surface 4021 and the second inner surface 5022 oppose each other in the circumferential direction. The second outer surface 4022 and the first inner surface 5021 oppose each other in the circumferential direction. The first outer surface 4021 and the second inner surface 5022 may be in contact with each other at least partially. The second outer surface 4022 and the first inner surface 5021 may be in contact with each other at least partially.

In the work of attaching the first housing 4 to the second housing 5, the wiring convex portion 401 is located above the wiring recess 501. For example, the wiring convex portion 401 is inserted into the wiring recess 501 while being guided by the first inner surface 5021 and the second inner surface 5022.

Here, the wiring convex portion 401 has a tapered shape from one side to the other side in the axial direction when viewed from the radial direction. That is, in the wiring convex portion 401, the tip portion which is a portion on the lower side has a smaller width in the circumferential direction than the root portion which is a portion on the upper side.

Specifically, the first outer surface 4021 has a surface 4211 parallel to the axial direction on the upper side and an inclined surface 4212 inclined with respect to the axial direction on the lower side. In other words, the first outer surface 4021 has the inclined surface 4212 inclined toward the other side in the circumferential direction toward the other side in the axial direction. On the other hand, the second outer surface 4022 is a surface parallel to the axial direction.

By providing the inclined surface 4212 on the first outer surface 4021 of the wiring convex portion 401, the wiring convex portion 401 has a tapered shape from one side to the other side in the axial direction, so that the wiring convex portion 401 can be easily inserted into the wiring recess 501 in attachment work of the first housing 4 to the second housing 5.

Since the second outer surface 4022 of the wiring convex portion 401 is a surface parallel to the axial direction, the wiring convex portion 401 can be linearly guided in the axial direction when the wiring convex portion 401 is inserted into the wiring recess 501. This facilitates the work of inserting the wiring convex portion 401 into the wiring recess 501. In other words, it is easy to attach the second housing 5 to the first housing 4.

The lead wire 20 drawn out from the housing 3 is located along the radially outer surface of the housing 3. Specifically, the lead wire 20 extends from the through-hole of the lead wire passing portion 3100 to one side in the axial direction. That is, the lead wire 20 extends from the second housing 5 toward the first housing 4 on the radially outer side of the housing 3.

The lead wire 20 is fixed to the radially outer surface of the housing 3. In other words, the lead wire 20 is held so as not to be separated from the radially outer surface of the housing 3.

Specifically, as illustrated in FIG. 1, the housing 3 includes a lead wire pressing portion 3200. The lead wire pressing portion 3200 is provided in at least one of the first housing 4 and the second housing 5. The lead wire pressing portion 3200 is located on the radially outer side of the lead wire 20 drawn out from the housing 3 (see FIG. 20). In other words, at least a part of the lead wire 20 is pressed from the radially outer side to the radially inner side by the lead wire pressing portion 3200. Accordingly, the lead wire 20 can be easily fixed to the radially outer surface of the housing 3.

In this manner, the lead wire 20 is fixed to the radially outer surface of the housing 3 by being pressed by the lead wire pressing portion 3200 on the radially outer side of the housing 3. In this fixing method, it is necessary to insert the lead wire 20 between the radially outer surface of the housing 3 and the lead wire pressing portion 3200.

Therefore, an end portion on one side in the circumferential direction of the lead wire pressing portion 3200 is a free end portion 3210 located at a distance in the radial direction from the radially outer surface of the housing 3, and an end portion on the other side in the circumferential direction is a fixed end portion 3220 connected to the radially outer surface of the housing 3 (see FIG. 15). A part of the free end portion 3210 is inclined in the circumferential direction with respect to the axial direction.

For example, the lead wire pressing portion 3200 is the same member as the housing 3, and is formed integrally with the housing 3. The fixed end portion 3220 extends from a corner of the housing 3. The lead wire pressing portion 3200 elastically deforms in a direction away from and approaching the radially outer surface of the housing 3 with the fixed end portion 3220 as a fulcrum.

In this configuration, when the lead wire 20 is fixed to the radially outer surface of the housing 3, the lead wire 20 can be inserted between the radially outer surface of the housing 3 and the lead wire pressing portion 3200 from the free end portion 3210 side. At this time, since a part of the free end portion 3210 is inclined toward the fixed end portion 3220, the work of inserting the lead wire 20 between the radially outer surface of the housing 3 and the lead wire pressing portion 3200 is facilitated.

The radially outer surface of the housing 3 has a wiring portion 301 recessed to the radially inner side. The recess constituting the wiring portion 301 extends in the axial direction. That is, the housing 3 has a groove extending in the axial direction as the wiring portion 301. The lead wire pressing portion 3200 is located at a position radially opposing the wiring portion 301. This makes it possible to increase the distance between the radially outer surface of the housing 3 and the lead wire pressing portion 3200. As a result, the lead wire 20 can be easily located between the radially outer surface of the housing 3 and the lead wire pressing portion 3200.

The groove as the wiring portion 301 extends upward from the through-hole of the lead wire passing portion 3100. In other words, the bottom surface of the groove as the wiring portion 301 is constituted by a part of the radially outer surface of the first housing 4 and the radially outer surface of the wiring convex portion 401. In other words, the wiring portion 301 is provided on the radially outer surface of the first housing 4.

The wiring portion 301 includes a first wiring portion 3011 and a second wiring portion 3012 having a larger thickness in the radial direction than first wiring portion 3011 (see FIG. 15). The second wiring portion 3012 is located on one side in the axial direction with respect to the first wiring portion 3011. That is, in the first housing 4, the thickness in the radial direction is larger on the upper side of the wiring portion 301 than on the lower side of the wiring portion 301.

In this configuration, even if the wiring portion 301 is provided in the first housing 4, it is possible to suppress generation of a thin portion at the upper end portion of the first housing 4. That is, it is possible to prevent a part of the thickness of the outer edge portion of the intake and exhaust port from becoming thin. As a result, it is possible to suppress generation of vibration during rotation of the rotor blade 210.

Here, the lead wire pressing portion 3200 includes a first lead wire pressing portion 4020 and a second lead wire pressing portion 5020 (see FIG. 15). The first lead wire pressing portion 4020 is provided in the first housing 4. The second lead wire pressing portion 5020 is provided in the second housing 5. Thus, the lead wire 20 can be pressed on both the first housing 4 side and the second housing 5 side. Thus, the lead wire 20 can be fixed.

The first lead wire pressing portion 4020 has a first inclined portion 4201 that is inclined toward the fixed end portion 3220 as it goes toward the other side in the axial direction when viewed from the radial direction, and the second lead wire pressing portion 5020 has a second inclined portion 5201 that is inclined toward the fixed end portion 3220 as it goes toward one side in the axial direction when viewed from the radial direction. That is, both the free end portions 3210 of the first lead wire pressing portion 4020 and the second lead wire pressing portion 5020 are inclined toward the fixed end portion 3220 as viewed from the radial direction. As a result, even if the first lead wire pressing portion 4020 and the second lead wire pressing portion 5020 are provided in the first housing 4 and the second housing 5, respectively, the work of inserting the lead wire 20 between the radially outer surface of the housing 3 and the lead wire pressing portion 3200 becomes easy.

Further, the first inclined portion 4201 is located on the other side in the axial direction of the first lead wire pressing portion 4020, and the second inclined portion 5201 is located on one side in the axial direction of the second lead wire pressing portion 5020 (see FIG. 1). In this configuration, the lead wire pressing portion 3200 has a shape in which a substantially central portion in the axial direction is recessed in the circumferential direction when viewed from the radial direction. This facilitates insertion of the lead wire 20 from the substantially central portion in the axial direction of the lead wire pressing portion 3200. The lead wire 20 can be pressed at the upper portion and the lower portion of the lead wire pressing portion 3200.

The first lead wire pressing portion 4020 and the second lead wire pressing portion 5020 are located continuously in the axial direction (see FIG. 1). For example, the lower end surface of the first lead wire pressing portion 4020 and the upper end surface of the second lead wire pressing portion 5020 may be in contact with each other. Accordingly, the lead wire 20 can be securely fixed. The exposed portion of the lead wire 20 can be reduced by making the first lead wire pressing portion 4020 and the second lead wire pressing portion 5020 continuous in the axial direction. Therefore, it is possible to suppress contact between the lead wire 20 and another member (not illustrated) located on the radially outer side of the lead wire pressing portion 3200. In other words, the lead wire 20 can be protected by the lead wire pressing portion 3200.

The circumferential width of the first lead wire pressing portion 4020 is larger than the circumferential width of the second lead wire pressing portion 5020. That is, the circumferential width of the second lead wire pressing portion 5020 is smaller than the circumferential width of the first lead wire pressing portion 4020. The circumferential width of the second lead wire pressing portion 5020 is the maximum circumferential width of the first lead wire pressing portion, and the circumferential width of the second lead wire pressing portion 5020 is the maximum circumferential width of the second lead wire pressing portion 5020.

In the work of fixing the lead wire 20 to the radially outer surface of the housing 3, the lead wire 20 is drawn out from the second housing 5 side. In this case, when the circumferential width of the second lead wire pressing portion 5020 is small, it is easy to cause the lead wire 20 to extend along the radially outer surface of the housing 3. Since the circumferential width of the first lead wire pressing portion 4020 is large, even if the circumferential width of the second lead wire pressing portion 5020 is reduced, the lead wire 20 can be reliably fixed by the first lead wire pressing portion 4020.

The wiring recess 501 has a regulating portion 5030 (see FIGS. 19 and 20). The regulating portion 5030 protrudes in the circumferential direction. The regulating portion 5030 is provided on at least one of the first inner surface 5021 and the second inner surface 5022. That is, at least one of the first inner surface 5021 and the second inner surface 5022 has the regulating portion 5030 protruding in the circumferential direction. For example, the regulating portion 5030 is provided on both the first inner surface 5021 and the second inner surface 5022. The regulating portion 5030 of the first inner surface 5021 protrudes toward the second inner surface 5022. The regulating portion 5030 of the second inner surface 5022 protrudes toward the first inner surface 5021. That is, the regulating portion 5030 is a protruding portion protruding in the circumferential direction from each of the first inner surface 5021 and the second inner surface 5022.

The regulating portion 5030 is located on the radially outer side of the wiring convex portion 401 and faces the wiring convex portion 401 in the radial direction. As a result, even if the wiring convex portion 401 is deformed to the radially outer side, the radially outward deformation of the wiring convex portion 401 is restricted by the regulating portion 5030. As a result, deformation of the first housing 4 can be suppressed. The regulating portion 5030 may be in contact with the wiring convex portion 401.

The example embodiment of the present disclosure is described as above. Note that the scope of the present disclosure is not limited to the above-described example embodiment. The present disclosure can be implemented with various modifications within a scope not departing from the gist of the disclosure. The above-described example embodiment can be appropriately and optionally combined.

A third aspect of the present disclosure has the following configuration.

(1)
A motor including:
a rotor rotatable in a circumferential direction around a center axis extending vertically;
a stator rotating the rotor;
a lead wire electrically connected to the stator; and
a housing covering the rotor and the stator from a radially outer side, in which
the housing includes:
a first housing located on one side in an axial direction; and
a second housing located on another side in the axial direction,
the first housing has a wiring convex portion protruding toward the other side in the axial direction,
the second housing has a wiring recess that is recessed toward the other side in the axial direction and penetrates in a radial direction,
the wiring convex portion is located in the wiring recess,
the wiring convex portion has a tip surface opposing the other side in the axial direction,
the wiring recess has a bottom surface opposing the one side in the axial direction,
the lead wire is located between the tip surface and the bottom surface as viewed in the radial direction, and
at least a part of the tip surface is located at a position shifted in the radial direction from a position opposing the bottom surface in the axial direction.

(2)
The motor according to (1), in which
the wiring recess has a notch on the bottom surface,
the notch penetrates in the axial direction and is recessed to a radially outer side from a radially inner surface of the second housing, and
at least a part of the tip surface is located at a position opposing the notch in the axial direction.

(3)
The motor according to (2), in which a surface of the wiring convex portion opposing the radially inner side is flush with a radially inner surface of the second housing.

(4)
The motor according to (2), in which a surface of the wiring convex portion opposing the radially inner side is located on a radially outer side from a radially inner surface of the second housing.

(5)
The motor according to any one of (2) to (4), in which
the housing has a cylindrical portion centered on the center axis,
the cylindrical portion covers the rotor and the stator from the radially outer side,
the first housing includes a first cylindrical portion that is a portion of the cylindrical portion on one side in the axial direction,
the second housing includes a second cylindrical portion that is a portion of the cylindrical portion on another side in the axial direction,
the wiring recess is recessed from an end surface of the second cylindrical portion on one side in the axial direction toward another side in the axial direction,
the notch is recessed to the radially outer side from a radially inner surface of the second cylindrical portion, and
a thickness of the wiring convex portion in the radial direction is half or less of an opening width of the wiring recess in the radial direction as viewed from the axial direction.

(6)
The motor according to any one of (1) to (5), in which
the wiring convex portion includes:
a first outer surface opposing one side in the circumferential direction; and
a second outer surface opposing another side in the circumferential direction,
the first outer surface has an inclined surface that is inclined toward another side in the circumferential direction toward another side in the axial direction, and
the second outer surface is a surface parallel to the axial direction.

(7)
The motor according to any one of (1) to (6), in which
the lead wire is drawn out to the radially outer side from a radially inner side of the housing,
the lead wire drawn out from the housing is located on a radially outer surface of the housing,
the housing includes a lead wire pressing portion,
the lead wire pressing portion is provided on at least one of the first housing and the second housing, and located on the radially outer side of the lead wire drawn out from the housing.

(8)

The motor according to (7), in which an end portion on one side in the circumferential direction of the lead wire pressing portion is a free end portion located at an interval in the radial direction with respect to a radially outer surface of the housing, and an end portion on another side in the circumferential direction is a fixed end portion connected to a radially outer surface of the housing, and a part of the free end portion is inclined in the circumferential direction with respect to the axial direction.

(9)

The motor according to (7) or (8), in which a radially outer surface of the housing has a wiring portion recessed to a radially inner side, and the lead wire pressing portion is located at a position opposing the wiring portion in the radial direction.

(10)

The motor according to (9), in which the wiring portion is provided on a radially outer surface of the first housing, the wiring portion includes:

a first wiring portion;

a second wiring portion having a larger thickness in the radial direction than the first wiring portion, and the second wiring portion is located on one side in the axial direction with respect to the first wiring portion.

(11)

The motor according to any one of (1) to (10), in which the wiring recess includes:

a first inner surface opposing one side in the circumferential direction; and a second inner surface opposing another side in the circumferential direction, at least one of the first inner surface and the second inner surface includes a regulating portion protruding in the circumferential direction, and the regulating portion is located on the radially outer side of the wiring convex portion and faces the wiring convex portion in the radial direction.

(12)

A motor including:

a rotor rotatable in a circumferential direction around a center axis extending vertically;

a stator rotating the rotor;

a lead wire electrically connected to the stator; and a housing covering the rotor and the stator from a radially outer side, the housing includes:

a first housing located on one side in an axial direction; and a second housing located on another side in the axial direction, the first housing has a wiring convex portion protruding toward the other side in the axial direction, the second housing has a wiring recess that is recessed toward the other side in the axial direction and penetrates in a radial direction, the wiring convex portion is located in the wiring recess, the wiring convex portion has a tip surface opposing the other side in the axial direction, the wiring recess has a bottom surface opposing one side in the axial direction, the lead wire is located between the tip surface and the bottom surface as viewed in the radial direction, the lead wire is drawn out to the radially outer side from a radially inner side of the housing, the lead wire drawn out from the housing is located on a radially outer surface of the housing, the housing includes a lead wire pressing portion, the lead wire pressing portion is provided on at least one of the first housing and the second housing, and located on the radially outer side of the lead wire drawn out from the housing, an end portion on one side in the circumferential direction of the lead wire pressing portion is a free end portion located at an interval in the radial direction with respect to a radially outer surface of the housing, and an end portion on the other side in the circumferential direction is a fixed end portion connected to a radially outer surface of the housing, and a part of the free end portion is inclined in the circumferential direction with respect to the axial direction.

(13)

The motor according to (12), in which the lead wire pressing portion includes:

a first lead wire pressing portion provided in the first housing; and a second lead wire pressing portion provided in the second housing, the first lead wire pressing portion includes a first inclined portion that is inclined toward the fixed end portion with decreasing distance toward the other side in the axial direction as viewed from the radial direction, the second lead wire pressing portion includes a second inclined portion that is inclined toward the fixed end portion with decreasing distance toward one side in the axial direction when viewed from the radial direction, the first inclined portion is located on the other side of the first lead wire pressing portion in the axial direction, and the second inclined portion is located on one side of the second lead wire pressing portion in the axial direction.

(14)

The motor according to (13), in which the first lead wire pressing portion and the second lead wire pressing portion are located continuously in the axial direction.

(15)

The motor according to (13) or (14), in which a width of the first lead wire pressing portion in the circumferential direction is larger than width of the second lead wire pressing portion in the circumferential direction.

(16)

An axial fan including:

the motor according to any one of (1) to (16); and a rotor blade attached to the rotor.

The present disclosure can be used as, for example, a motor for an axial fan.

Features of the above-described example embodiments and the modifications thereof may be combined appropriately as long as no conflict arises.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. A motor comprising:

a rotor rotatable about a center axis extending vertically;

a stator to rotate the rotor; and a housing covering the rotor and the stator from a radially outer side; wherein the housing includes:

a first housing located on a first side in an axial direction; and a second housing located on a second side in the axial direction;

the first housing includes:

a first opposing surface opposing the second housing in the axial direction; and a first wall portion extending from the first opposing surface to the second side in the axial direction;

the second housing includes:

a second opposing surface opposing the first housing in the axial direction;

a second wall portion extending from the second opposing surface to the first side in the axial direction; and a base portion holding the stator;

the first wall portion and the second wall portion oppose each other in a radial direction; the second housing further includes a third wall portion;

the first Wall portion includes:

an overlapping portion overlapping the third wall portion in the radial direction; and a circumferential end portion protruding in a circumferential direction from the overlapping portion;

the circumferential end portion includes a protruding portion protruding to the radially outer side;

the protruding portion opposes an end surface of the third wall portion opposing the circumferential direction; and the circumferential end portion is located at a different position in the circumferential direction than the third wall portion such that the circumferential end portion and the third wall portion do no overlap one another when viewed in the radial direction.

2. The motor according to claim 1, wherein the first wall portion and the second wall portion are in contact with each other in the radial direction.

3. The motor according to claim 2, wherein the second wall portion includes a protrusion on a radially outer surface; and the protrusion protrudes to the radially outer side and contacts a radially inner surface of the first wall portion.

4. The motor according to claim 1, wherein an end surface of the second wall portion opposing the first side in the axial direction is in contact with the first opposing surface.

5. The motor according to claim 1, wherein an end surface of the first wall portion opposing the second side in the axial direction is in contact with the second opposing surface.

6. The motor according to claim 1, wherein the second wall portion is located on a radially inner side of the first wall portion.

7. The motor according to claim 6, wherein the third wall portion extends from the second opposing surface to the first side in the axial direction; and the third wall portion is located on a radially outer side of the first wall portion.

8. The motor according to claim 7, wherein the third wall portion opposes the second wall portion in the radial direction with the first wall portion interposed therebetween.

9. The motor according to claim 1, wherein the first wall portion includes a convex portion protruding to the radially inner side with respect to the overlapping portion; and the second wall portion includes a recess that is recessed toward the second side in the axial direction and penetrates the second wall portion in the radial direction; and the convex portion is located in the recess.

10. The motor according to claim 9, wherein an outer shape of the housing is a quadrangular shape including four corners when viewed from the axial direction;

each of the four corners respectively includes one of four through-holes penetrating in the axial direction;

the first wall portion includes connection portions connected to outer edge portions of the through-holes, and extends in the circumferential direction from the connection portions; and the convex portion is located in the connection portions.

11. The motor according to claim 1, wherein an outer shape of the housing is a quadrangular shape including four corners when viewed from the axial direction, and the first wall portion is located at any one of the corners.

12. The motor according to claim 11, wherein the first wall portion is located at each of a pair of the corners located on a diagonal of the housing.

13. The motor according to claim 1, wherein the first housing includes at least one of an engagement claw protruding in the radial direction and an engagement hole engaged with the engagement claw; and the second housing has at least another of the engagement claw and the engagement hole.

14. The motor according to claim 13, wherein an outer shape of the housing is a quadrangular shape including four corners when viewed from the axial direction;

the first housing includes two of the engagement claws and two of the engagement holes;

the second housing includes two of the engagement claws and two of the engagement holes;

each of the engagement claws of the first housing is arranged at a respective one of a pair of the corners located on a first diagonal of the housing, and each of the engagement holes of the first housing is arranged at a respective one of a pair of the corners located on a second diagonal of the housing; and each of the engagement holes of the second housing is located at a respective one of a pair of the corners located on the first diagonal, and each of the engagement claws of the second housing is located at a respective one of a pair of the corners located on the second diagonal.

15. An axial fan comprising:

the motor according to claim 1; and a rotor blade attached to the rotor.

16. A motor comprising:

a rotor rotatable about a center axis extending vertically;

a stator to rotate the rotor; and a housing covering the rotor and the stator from a radially outer side; wherein the housing includes:

a first housing located on a first side in an axial direction; and a second housing located on a second side in the axial direction;

the first housing includes:

a first opposing surface opposing the second housing in the axial direction; and a first wall portion extending from the first opposing surface to the second side in the axial direction;

the second housing includes:

a second opposing surface opposing the first housing in the axial direction;

a second wall portion extending from the second opposing surface to the first side in the axial direction; and a base portion holding the stator;

the first wall portion and the second wall portion oppose each other in a radial direction;

the first housing includes at least one of an engagement claw protruding in the radial direction and an engagement hole engaged with the engagement claw;

the second housing has at least another of the engagement claw and the engagement hole;

an outer shape of the housing is a quadrangular shape including four corners when viewed from the axial direction;

the first housing includes two of the engagement claws and two of the engagement holes;

the second housing includes two of the engagement claws and two of the engagement holes;

each of the engagement claws of the first housing is arranged at a respective one of a pair of the corners located on a first diagonal of the housing, and each of the engagement holes of the first housing is arranged at a respective one of a pair of the corners located on a second diagonal of the housing; and each of the engagement holes of the second housing is located at a respective one of a pair of the corners located on the first diagonal, and each of the engagement claws of the second housing is located at a respective one of a pair of the corners located on the second diagonal.

* * * * *